US011613825B2

(12) United States Patent
Hubbard et al.

(10) Patent No.: US 11,613,825 B2
(45) Date of Patent: Mar. 28, 2023

(54) COMPOSITION AND METHOD EMBODIMENTS FOR PLATING METAL COATINGS

(71) Applicant: Battelle Memorial Institute, Richland, WA (US)

(72) Inventors: Lance Hubbard, Richland, WA (US); Christina Arendt, Richland, WA (US); Ryan Webster, Spokane Valley, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 16/884,999

(22) Filed: May 27, 2020

(65) Prior Publication Data

US 2020/0378027 A1 Dec. 3, 2020

Related U.S. Application Data

(60) Provisional application No. 62/853,580, filed on May 28, 2019.

(51) Int. Cl.

| | |
|---|---|
| ***C25D 5/00*** | (2006.01) |
| ***C25D 3/54*** | (2006.01) |
| ***C25D 5/18*** | (2006.01) |

(52) U.S. Cl.

CPC ..... *C25D 3/54* (2013.01); *C25D 5/18* (2013.01)

(58) Field of Classification Search

CPC ..... C25D 3/665; C25D 5/00
USPC ..... 205/230, 232, 233
See application file for complete search history.

(56) References Cited

U.S. PATENT DOCUMENTS

| | | | | |
|---|---|---|---|---|
| 4,017,368 | A | 4/1977 | Wax et al. | |
| 2010/0285322 | A1 | 11/2010 | Inoue et al. | |
| 2015/0144495 | A1* | 5/2015 | Chen | C25D 21/18 205/261 |
| 2015/0292098 | A1* | 10/2015 | Benaben | C25D 7/00 205/267 |
| 2018/0016697 | A1* | 1/2018 | Konopka | C25D 13/12 |

(Continued)

FOREIGN PATENT DOCUMENTS

| | | | | |
|---|---|---|---|---|
| CN | 103422123 A | * | 12/2013 | C23C 3/36 |
| GB | 2534883 A | * | 8/2016 | C25D 3/04 |

(Continued)

OTHER PUBLICATIONS

Vicenzo et al., "Structure and Electrokinetic Study of Nickel Electrodeposition," Russian Journal of Electrochemistry (Jun. 2008), vol. 44, No. 6, pp. 716-727. (Year: 2008).*

(Continued)

*Primary Examiner* — Edna Wong
(74) *Attorney, Agent, or Firm* — Klarquist Sparkman, LLP

(57) ABSTRACT

Disclosed herein are embodiments of a coating composition and a method of using the same for forming metal coatings on substrates. In particular embodiments, the coating composition comprises a deep eutectic solvent and/or an ionic liquid; a metal precursor; an alkali metal salt; and an optional additive component. The coating composition and method embodiments disclosed herein provide durable, even, high-surface area coatings on various types of substrates and also can be used at low temperatures.

23 Claims, 11 Drawing Sheets

(56) References Cited

U.S. PATENT DOCUMENTS

| | | | | |
|---|---|---|---|---|
| 2018/0030608 | A1* | 2/2018 | Kwok | C25D 7/00 |
| 2018/0245227 | A1* | 8/2018 | Abbott | C25D 3/06 |

FOREIGN PATENT DOCUMENTS

| | | | | |
|---|---|---|---|---|
| IE | 46366 | B1 * | 5/1983 | C25D 3/02 |
| WO | WO-2018167315 | A2 * | 9/2018 | C07D 213/22 |

OTHER PUBLICATIONS

Abbott et al., "Electroplating using ionic liquids," *Annu. Rev. Mater. Res.*, vol. 43, pp. 335-358, Jan. 16, 2013.

Aurbach et al., "On nonaqueous electrochemical behavior of titanium and $Ti^{4+}$ compounds," *Electrochimica Acta*, 52(5): 2097-2101, Sep. 28, 2006.

Bernasconi et al., "Electrodeposition from deep eutectic solvents," published in *Progress and Developments in Ionic Liquids*, ed. Scott Handy, Feb. 22, 2017.

Coffey et al., "Concept Feasibility Report for Electroplating Zirconium onto Uranium Foil," prepared by Pacific Northwest National Laboratory, 44 pages, Mar. 2015.

Endres et al., "On the electrodeposition of titanium in ionic liquids," *Phys. Chem. Chem. Phys.*, 16(10): 2189-2199, Feb. 27, 2008.

Mais, "*Electrodeposition of Nb, Ta, Zr and Cu from Ionic Liquid for Nanocomposites Preparation*," Ph.D. Dissertation submitted to University of Cagliari, Italy, Mar. 2015.

Simka et al., "Electrodeposition of metals from non-aqueous solutions," *Electrochimica Acta*, 54(23): 5307-5319, Sep. 30, 2009.

* cited by examiner

COMPOSITION AND METHOD EMBODIMENTS FOR PLATING METAL COATINGS

CROSS REFERENCE TO RELATED APPLICATION

This application claims the benefit of the earlier filing date of U.S. Provisional Patent Application No. 62/853,580, filed on May 28, 2019, the entirety of which is incorporated herein by reference.

ACKNOWLEDGMENT OF GOVERNMENT SUPPORT

This invention was made with Government support under Contract DE-AC05-76RL01830 awarded by the U.S. Department of Energy. The Government has certain rights in the invention.

FIELD

Disclosed herein are embodiments of a coating composition and a method for depositing metal coatings on various types of substrates.

BACKGROUND

Refractory metal coatings are uniquely capable of serving as chemical diffusion, corrosion, and/or erosion barriers. They have high melting temperatures and low corrosion and diffusion rates, making them ideal as barriers between systems which need to share energy but not mass. In the solar, furnace, and nuclear energy industries, the favorable thermal properties of refractories make them useful as buffers between high and low temperatures; however, refractory coatings are difficult to apply. Often, refractories are plated at high temperatures in molten salts, which can degrade the substrate onto which they are plated. Alternatively, certain metallic coatings can be electroplated using expensive ionic liquids; however, such techniques have their own set of drawbacks, such as poor/inconsistent coating coverage, brittleness, and contamination, resulting in poor-quality coatings. And, current ionic liquids cost several thousand dollars per liter, yet produce films with less than 90% surface coverage as well as cause deposition of salt species that enable interdiffusion through the deposited metal. There exists a need in the art for new coating compositions that can be used without relying solely on expensive ionic liquids and also a method by which durable, high-performing metal coatings can be deposited from such coating compositions various substrates in an even and efficient matter.

SUMMARY

Disclosed herein are embodiments of a coating composition, comprising: a deep eutectic solvent comprising an organic salt, a hydrogen-bond donor compound, or a combination thereof; an ionic liquid; a metal precursor; and an alkali metal salt.

Also disclosed herein are embodiments of a coating composition, comprising: a deep eutectic solvent, an ionic liquid, or a combination thereof a zirconium precursor; and an alkali metal salt. Also disclosed herein are embodiments of a coating composition, comprising: a deep eutectic solvent, an ionic liquid, or a combination thereof; a titanium precursor; and an alkali metal salt.

Also disclosed herein are embodiments of a method, comprising: combining a coating composition of the present disclosure with a substrate in a cell comprising one or more electrodes; and exposing the cell to a voltage using the one or more electrodes to thereby deposit a metal coating on the substrate from the coating composition.

The foregoing and other objects and features of the present disclosure will become more apparent from the following detailed description, which proceeds with reference to the accompanying figures.

BRIEF DESCRIPTION OF THE DRAWINGS

FIG. 3A shows a Mo substrate comprising a Zr coating formed using a coating composition of the present disclosure comprising a deep eutectic solvent (or "DES") without any ionic liquid; FIG. 3B shows a Mo substrate comprising a Zr coating formed using a coating composition comprising a DES with an ionic liquid, wherein the two are included at a ratio of 3:1 DES:ionic liquid; FIG. 3C shows a Mo substrate comprising a Zr coating formed using a coating composition comprising a DES with an ionic liquid, wherein the two are included at a ratio of 1:1 DES:ionic liquid; FIG. 3D shows a Mo substrate comprising a Zr coating formed using a coating composition comprising a DES with an ionic liquid, wherein the two are included at a ratio of 1:3 DES:ionic liquid; and FIG. 3E shows a Mo substrate comprising a Zr coating formed using a coating composition comprising an ionic liquid without a DES.

DETAILED DESCRIPTION

Overview of Terms

Figure 1:
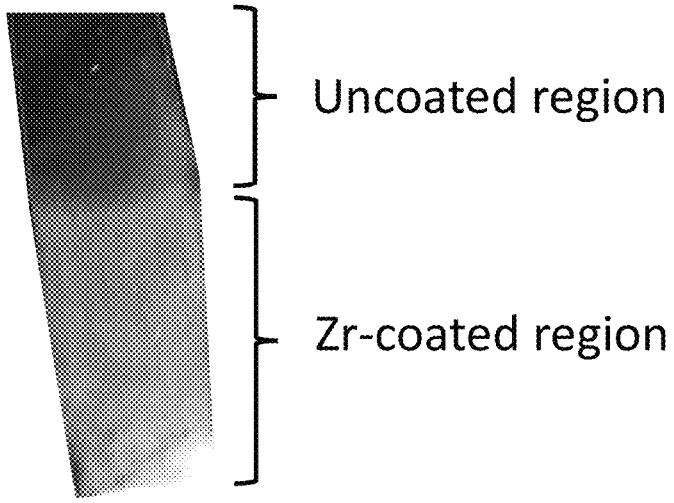
FIG. 1 is a photographic image of a molybdenum (Mo) substrate wherein a portion of the Mo substrate has been coated with zirconium (Zr) obtained from using a coating composition embodiment and a method embodiment disclosed herein.

The following explanations of terms and abbreviations are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the following detailed description and the claims.

Unless otherwise indicated, all numbers expressing quantities of components, molecular weights, molarities, voltages, capacities, and so forth, as used in the specification or claims are to be understood as being modified by the term "about." Accordingly, unless otherwise implicitly or explicitly indicated, or unless the context is properly understood by a person of ordinary skill in the art to have a more definitive construction, the numerical parameters set forth are approximations that may depend on the desired properties sought and/or limits of detection under standard test conditions/methods as known to those of ordinary skill in the art. When directly and explicitly distinguishing embodiments from discussed prior art, the embodiment numbers are not approximates unless the word "about" is recited.

Although there are alternatives for various components, parameters, operating conditions, etc. set forth herein, that does not mean that those alternatives are necessarily equivalent and/or perform equally well. Nor does it mean that the alternatives are listed in a preferred order unless stated otherwise. Unless otherwise stated, any of the groups defined below can be substituted or unsubstituted.

In order to facilitate review of the various embodiments of the disclosure, the following explanations of specific terms are provided:

Additive Component: A component that can optionally be included in coating composition embodiments of the present disclosure. Additive components can be used in some embodiments to facilitate increasing coating thickness while also decreasing deposition time.

Aliphatic: A hydrocarbon group having at least one carbon atom to 50 carbon atoms (C1-50), such as one to 25 carbon atoms (C1-25), or one to ten carbon atoms (C1-10), and which includes alkanes (or alkyl), alkenes (or alkenyl), alkynes (or alkynyl), including cyclic versions thereof, and further including straight- and branched-chain arrangements, and all stereo and position isomers as well. Aliphatic groups are distinct from aromatic groups.

Aromatic: A cyclic, conjugated group or moiety of, unless specified otherwise, from 5 to 15 ring atoms having a single ring (e.g., phenyl) or multiple condensed rings in which at least one ring is aromatic (e.g., naphthyl, indolyl, or pyrazolopyridinyl); that is, at least one ring, and optionally multiple condensed rings, have a continuous, delocalized Tr-electron system. Typically, the number of out of plane π-electrons corresponds to the Hückel rule (4n+2). The point of attachment to the parent structure typically is through an aromatic portion of the condensed ring system. For example,

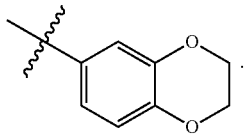

However, in certain examples, context or express disclosure may indicate that the point of attachment is through a non-aromatic portion of the condensed ring system. For example,

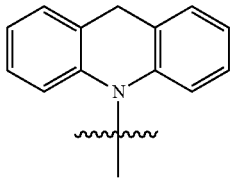

An aromatic group or moiety may comprise only carbon atoms in the ring, such as in an aryl group or moiety, or it may comprise one or more ring carbon atoms and one or more ring heteroatoms comprising a lone pair of electrons (e.g. S, O, N, P, or Si), such as in a heteroaryl group or moiety. Aromatic groups may be substituted with one or more groups other than hydrogen.

Bis-Substituted Imide: A compound comprising a di-substituted nitrogen atom that is bound to two substituents and has a negative charge. In particular embodiments, the di-substituted nitrogen atom is bound to two heteroaliphatic groups and/or organic functional groups each of which can be the same or different.

Deep Eutectic Solvent (DES): A fluid (typically a liquid) comprising a mixture of an organic salt component and a hydrogen-bonding donor component and wherein the mixture (that is, the DES) has a melting point that is lower than the organic salt component and the hydrogen-bonding donor component. In embodiments disclosed herein, DES embodiments are distinct from an ionic liquid component used in any coating composition embodiment.

Haloaliphatic: An aliphatic group wherein one or more hydrogen atoms, such as one to 10 hydrogen atoms, independently is replaced with a halogen atom, such as fluoro, bromo, chloro, or iodo.

Heteroaliphatic: An aliphatic group comprising at least one heteroatom to 20 heteroatoms, such as one to 15 heteroatoms, or one to 5 heteroatoms, which can be selected from, but not limited to oxygen, nitrogen, sulfur, silicon, boron, selenium, phosphorous, and oxidized forms thereof within the group. Alkoxy, ether, amino, disulfide, peroxy, and thioether groups are exemplary (but non-limiting) examples of heteroaliphatic. In some embodiments, a fluorophore can also be described herein as a heteroaliphatic group, such as when the heteroaliphatic group is a heterocyclic group.

Ionic Liquid: A salt that has a fluidic (e.g., liquid) form. In some embodiments, the salt has a melting point lower than its surrounding ambient temperature. In embodiments disclosed herein, ionic liquid embodiments are distinct from a DES used in any coating composition embodiment.

Metal Coating: A layer (or multiple layers) of a metal material that is deposited onto a substrate by electroplating. In particular embodiments, the metal coating comprises metallic zirconium or metallic titanium. In some embodiments, the coating can contain low levels of impurities that do not deleteriously affect the ability to form the coating or its performance, such as, sulfur (which can be present in some embodiments at a pph level). In an independent embodiment, the impurities can include Cu, Mg, Li, Ca, or the like, at trace amounts (e.g., less than 5%, such as less than 4%, or less than 3%, or less than 2%, or less than 1%).

Metal Precursor: A salt species comprising a metal component and a counterion and that can be reduced to a corresponding metal by electroplating. In some embodiments, the metal precursor is a zirconium salt species or a titanium salt species. In some embodiments, the counterion is a halide, such as a fluoride.

Organic Functional Group: A functional group that may be provided by any combination of aliphatic, heteroaliphatic, aromatic, and/or haloaliphatic groups, or that may be selected from, but not limited to, aldehyde (i.e., —C(O)H); aroxy (i.e., —O-aromatic); acyl halide (i.e., —C(O)X, wherein X is a halogen, such as Br, F, I, or C); halogen; nitro (i.e., $—NO_2$); cyano (i.e., —CN); azide (i.e., $—N_3$); carboxyl (i.e., —C(O)OH); carboxylate (i.e., —C(O)O— or salts thereof, wherein the negative charge of the carboxylate group may be balanced with an $M^+$ counterion, wherein $M^+$ may be an alkali ion, such as $K^+$, $Na^+$, $Li^+$; an ammonium ion, such as $^+N(R^b)_4$ where $R^b$ is H, aliphatic, heteroaliphatic, haloaliphatic, or aromatic; or an alkaline earth ion, such as $[Ca^{2+}]_{0.5}$, $[Mg^{2+}]_{0.5}$, or $[Ba^{2+}]_{0.5}$); amide (i.e., $—C(O)NR^aR^b$ or $—NR^aC(O)R^b$ wherein each of $R^a$ and $R^b$ independently is selected from hydrogen, aliphatic, heteroaliphatic, haloaliphatic, aromatic, or an organic functional group); ketone (i.e., $—C(O)R^a$, wherein $R^a$ is selected from aliphatic, heteroaliphatic, haloaliphatic, aromatic, or an organic functional group); carbonate (i.e., $—OC(O)OR^a$, wherein $R^a$ is selected from aliphatic, heteroaliphatic, haloaliphatic, aromatic, or an organic functional group); imine (i.e., $—C(=NR^a)R^b$ or $—N=CR^aR^b$, wherein $R^a$ and $R^b$ independently is selected from hydrogen, aliphatic, heteroaliphatic, haloaliphatic, aromatic, or an organic functional group); azo (i.e., $—N=NR^a$ wherein $R^a$ is hydrogen, aliphatic, heteroaliphatic, haloaliphatic, aromatic, or an organic functional group); carbamate (i.e., $—OC(O)NR^aR^b$, wherein each of $R^a$ and $R^b$ independently is selected from hydrogen, aliphatic, heteroaliphatic, haloaliphatic, aromatic, or an organic functional group); hydroxyl (i.e., —OH); thiol (i.e., —SH); sulfonyl (i.e., $—SO_2R^a$, wherein $R^a$ is selected from hydrogen, aliphatic, heteroaliphatic, haloaliphatic, aromatic, or an organic functional group); sulfonate (i.e., $—SO_3^-$, wherein the negative charge of the sulfonate group may be balanced with an $M^+$ counter ion, wherein $M^+$ may be an alkali ion, such as $K^+$, $Na^+$, $Li^+$; an ammonium ion, such as $^+N(R^b)_4$ where $R^b$ is H, aliphatic, heteroaliphatic, haloaliphatic, or aromatic; or an alkaline earth ion, such as $[Ca^{2+}]_{0.5}$, $[Mg^{2+}]_{0.5}$, or $[Ba^{2+}]_{0.5}$); oxime (i.e., $—CR^a=NOH$, wherein $R^a$ is hydrogen, aliphatic, heteroaliphatic, haloaliphatic, aromatic, or an organic functional group); sulfonamide (i.e., $—SO_2NR^aR^b$ or $—N(R^a)SO_2R^b$, wherein each of $R^a$ and $R^b$ independently is selected from hydrogen, aliphatic, heteroaliphatic, haloaliphatic, aromatic, or an organic functional group); ester (i.e., $—C(O)OR^a$ or $—OC(O)R^a$, wherein $R^a$ is selected from aliphatic, heteroaliphatic, haloaliphatic, aromatic, or an organic functional group); thiocyanate (i.e., —S—CN or —N=C=S); thioketone (i.e., $—C(S)R^a$ wherein $R^a$ is selected from hydrogen, aliphatic, heteroaliphatic, haloaliphatic, aromatic, or an organic functional group); thiocarboxylic acid (i.e., —C(O)SH, or —C(S)OH); thioester (i.e., $—C(O)SR^a$ or $—C(S)OR^a$ wherein $R^a$ is selected from hydrogen, aliphatic, heteroaliphatic, haloaliphatic, aromatic, or an organic functional group); dithiocarboxylic acid or ester (i.e., $—C(S)SR^a$ wherein $R^a$ is selected from hydrogen, aliphatic, heteroaliphatic, haloaliphatic, aromatic, or an organic functional group); phosphonate (i.e., $—P(O)(OR^a)_2$, wherein each $R^a$ independently is hydrogen, aliphatic, heteroaliphatic, haloaliphatic, aromatic, or an organic functional group; or wherein one or more $R^a$ groups are not present and the phosphate group therefore has at least one negative charge, which can be balanced by a counterion, $M^+$, wherein each $M^+$ independently can be an alkali ion, such as $K^+$, $Na^+$, $Li^+$; an ammonium ion, such as $^+N(R^b)_4$ where $R^b$ is H, aliphatic, heteroaliphatic, haloaliphatic, or aromatic; or an alkaline earth ion, such as $[Ca^{2+}]_{0.5}$, $[Mg^{2+}]_{0.5}$, or $[Ba^{2+}]_{0.5}$); phosphate (i.e., —O—P(O)$(OR^a)_2$, wherein each $R^a$ independently is hydrogen, aliphatic, heteroaliphatic, haloaliphatic, aromatic, or an organic functional group; or wherein one or more $R^a$ groups are not present and the phosphate group therefore has at least one negative charge, which can be balanced by a counterion, $M^+$, wherein each $M^+$ independently can be an alkali ion, such as $K^+$, $Na^+$, $Li^+$; an ammonium ion, such as $^+N(R^b)_4$ where $R^b$ is H, aliphatic, heteroaliphatic, haloaliphatic, or aromatic; or an alkaline earth ion, such as $[Ca^{2+}]_{0.5}$, $[Mg^{2+}]_{0.5}$, or $[Ba^{2+}]_{0.5}$); silyl ether (i.e., —OSi$R^aR^b$, wherein each of $R^a$ and $R^b$ independently is selected from hydrogen, aliphatic, heteroaliphatic, haloaliphatic, aromatic, or an organic functional group); sulfinyl (i.e., —S(O)$R^a$, wherein $R^a$ is selected from hydrogen, aliphatic, heteroaliphatic, haloaliphatic, aromatic, or an organic functional group); thial (i.e., —C(S)H); or combinations thereof.

Quaternary-Substituted Nitrogen: A nitrogen atom bound to four substituents and comprising a positive charge, wherein each substituent individually can be selected from hydrogen, aliphatic, heteroaliphatic, haloaliphatic, aromatic, or an organic functional group; or wherein two or more substituents can, together with the nitrogen atom to which they are bound, form a saturated or unsaturated ring. In particular embodiments, the nitrogen atom is bound to four substituents other than hydrogen.

Refractory Metal: A class of metals that exhibit resistance to heat and wear and that can have a melting point above 1,850° C., with some members of the class having a melting point above 2,200° C., but excluding technetium and rutherfordium. Exemplary refractory metals can include titanium vanadium, chromium, zirconium, hafnium, ruthenium, rhodium, osmium and iridium.

Substrate: A physical object having a surface onto which a coating can be electroplated. Substrates can be solid and/or porous and can have any shape and can be made of any material suitable for having a metallic coating formed thereon. In some embodiments, the substrate is a metal-based substrate.

Tri-Substituted Sulfur: A sulfur atom bound to three substituents and comprising a positive charge, wherein each substituent individually can be selected from hydrogen, aliphatic, heteroaliphatic, haloaliphatic, aromatic, or an organic functional group; or wherein two or more substituents can, together with the sulfur atom to which they are bound, form a saturated or unsaturated ring. In particular embodiments, the sulfur atom is bound to three substituents other than hydrogen.

Introduction

Refractory metal coatings are uniquely capable of serving as chemical diffusion, corrosion, and/or erosion barriers. They have high melting temperatures and low corrosion and diffusion rates, making them ideal as barriers between systems that need to share energy but not mass. Titanium, for example, is highly prized in the aerospace and biomedical industries. In the solar, furnace, and nuclear energy industries, the favorable thermal properties of refractories make them useful as buffers between high and low temperatures. For example, nuclear reactors are an extreme environment for materials, exhibiting high temperatures and aggressive conditions. Additionally, extended service life of parts is necessary, as replacement of parts is a major undertaking. Parts used in nuclear power plants should be highly resistant to corrosion, thereby practically requiring the use of refractory metals. Titanium tubing, as an example, can last forty years or more inside nuclear power plants; however, global consumption of titanium is only increasing, as the use of titanium in the aerospace and biomedical industries is growing. While titanium is a very abundant element, the metal cannot be made through continuous processing, leading to a high price due to the laborious process required to produce the metal. This means that parts made of pure titanium can be very costly to acquire. Depending on the application, it can be significantly more cost effective to utilize titanium (or other refractory metals, such as zirconium) plated parts, rather than the pure metals or alloys thereof. Such refractory coatings, however, are difficult to apply, particularly as thin coatings. Co-rolling or co-extrusion is considered state of the art but is limited to a select number of substrates and geometries. Refractory coatings can be plated at high temperatures in molten salts; however, this typically leads to degrading the substrate on to which they are placed. And, while molten salt electroplating has been commercialized to an extent, the substrates are even more limited than those that can be used in co-rolling processes, as the molten salt electroplating process is performed at 600° C. Molten salt electroplating also has issues with uneven deposition, the formation of metal salts, and dendritic growth of the metal, leading to brittleness and coating failure.

Alternatively, the coatings can be electroplated using compositions consisting of expensive ionic liquids. This method, however, also can experience issues with coating coverage, brittleness, and contamination, resulting in poor-quality coatings for certain metals, particularly metals that are sensitive to oxidation. PVD or plasma spray can also be used to apply thin coatings of refractory metals but cannot currently produce conformal coatings. Cleanliness issues and oxidation problems both lead to highly variable coating quality. Additionally, spray coatings are constrained by line-of-sight and cannot be used for complex geometries.

Particular refractory coatings that are of interest in the various industries using such coatings are Zr-based coatings and Ti-based coatings. Current methods of plating Zr include co-rolling, spray coatings (e.g., plasma spray), or electroplating from ZrF and/or LiF. Similarly, Ti-based coatings have been co-rolled and/or spray coated. Zr cannot be electroplated from aqueous solvents, as Zr metal has a higher reduction potential than the breakdown voltage of water. Co-rolling Zr and Ti has its drawbacks as scalding and poor cleaning prior to co-rolling can produce a 20% failure rate. On top of the high failure rate, the process is difficult or impossible to use on three-dimensional substrates requiring a uniform Zr or Ti thickness.

Molten salt electroplating is a 600° C. process that can produce a conformal Zr coating; however, at least one disadvantage of this process is uneven Zr deposition (particularly on a cm scale) and the difficulty in achieving a high-quality Zr coating. Issues with the Zr coating formed with such processes include dendritic Zr formation, incomplete coverage, and the inability to achieve a targeted Zr thickness. Zr spray coatings do not produce a conformal coating. Cleanliness issues in both the substrates and the Zr feedstock produce highly variable coatings. Electroplating from ionic liquids has the potential to purify the Zr feedstock as only one ion type can be deposited at a specified voltage.

Figure 2:
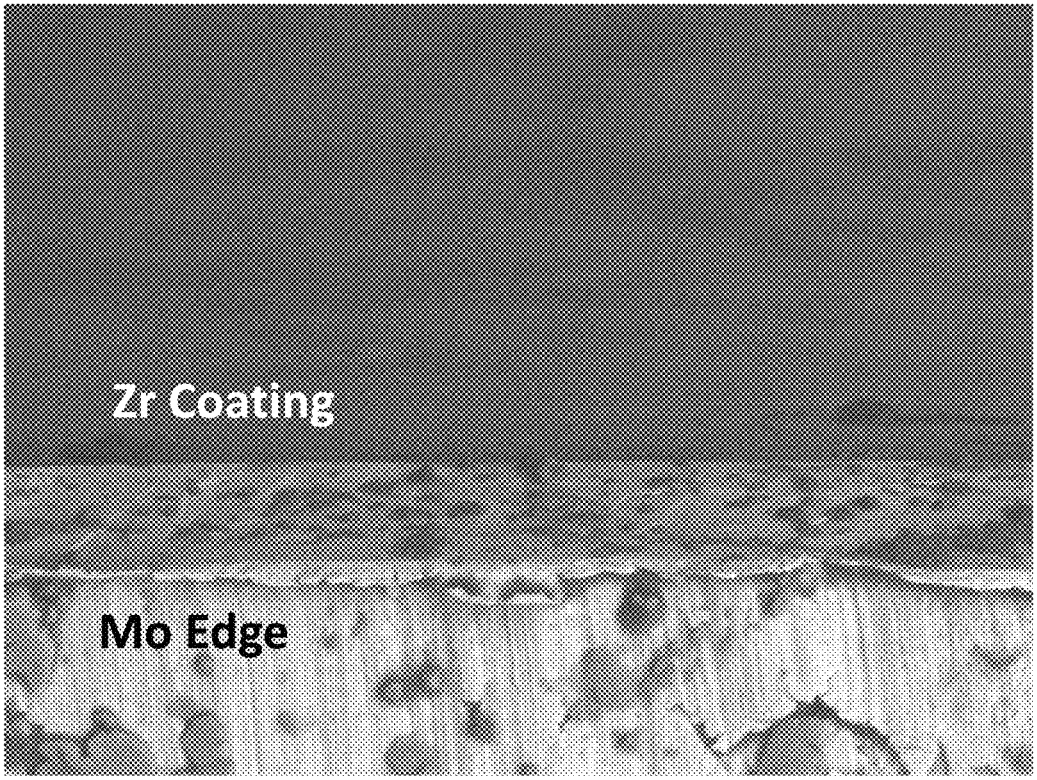
FIG. 2 is a micrograph obtained from using scanning-electron microscopy (SEM) to analyze a Mo substrate comprising a coating of Zr formed using a coating composition and method embodiment disclosed herein.
Figure 3A:
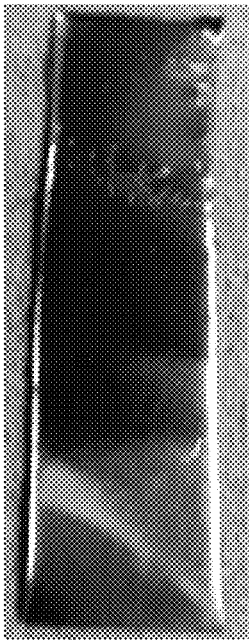
FIGS. 3A-3E are photographic images of Mo substrates comprising coatings formed using different coating composition embodiments disclosed herein.
Figure 3B:
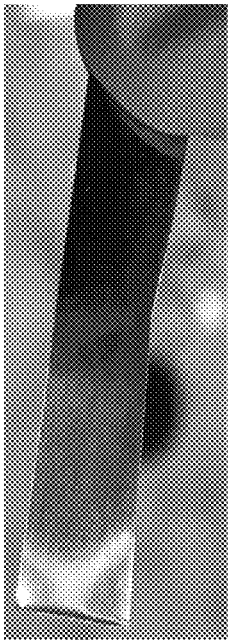
Figure 3C:
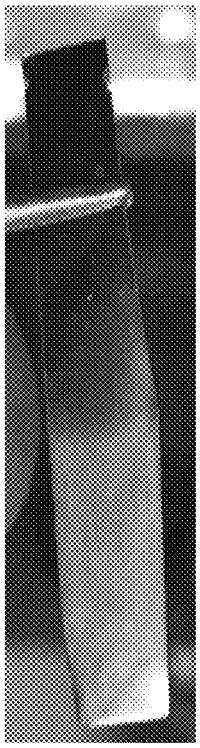
Figure 3D:
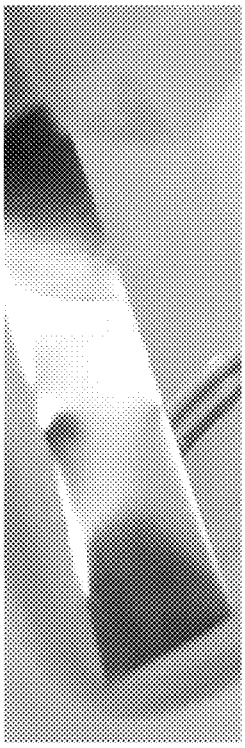
Figure 3E:
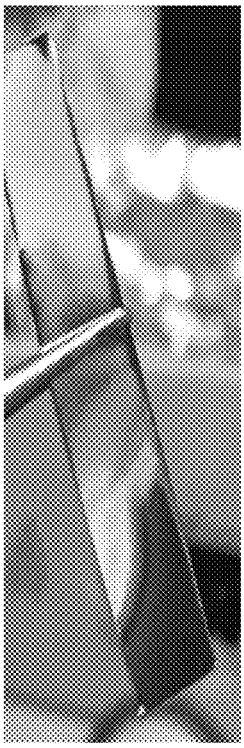

Disclosed herein are embodiments of a coating composition useful for providing metal coatings at low temperatures, and a method for depositing (e.g., electroplating) such metal coatings on various substrates using the coating composition embodiments. The coating composition and method embodiments of the present disclosure avoid many of the drawbacks discussed above. In some embodiments, the method is performed at near-room temperature and uses coating composition embodiments that can provide as much as a 200 times cost reduction in the process while also providing coatings that are smooth and uniform and exhibit good performance. Additionally, embodiments of the coating obtained from the coating composition can be controlled in terms of thickness and physical characteristics by modifying components of the coating composition and/or the voltage used in the method. And, in some embodiments, the deposited coatings are conformal to the substrate, cover large surface areas of any substrate, and lack dendritic and/or "pinhole" features. An image of a Mo substrate comprising a Zr coating formed from an exemplary coating composition and method embodiment disclosed herein is shown in FIG. 1, along with an SEM image showing the interface between the Zr coating and the Mo substrate, which is provided by FIG. 2.

Coating Composition and Method Embodiments

Disclosed herein are embodiments of a method for forming thin coatings of metals (e.g., refractory metals, such as Zr, Ti, V, Cr, Mn, Nb, Mo, Tc, Ru, Rh, Hf, Ta, W, Re, Os, or Ir) on substrates. The method embodiments of the present disclosure can be used to provide thin metal coatings for use in myriad applications, such as optical coatings (e.g., optical coatings used in solar technology), diffusion barriers, corrosion resistance, as well as in nuclear applications (e.g., diffusion barriers used for metallic fuels and oxidation-resistant outer layers for accident-tolerant fuel cladding).

In particular embodiments, the method comprises exposing a substrate to a coating composition and applying a voltage to deposit a metal coating formed from components of the coating composition. Additional features of the method are discussed herein. In some embodiments, the coating composition comprises, consists essentially of, or consists of a deep eutectic solvent (referred to herein as "DES"), a metal precursor, an alkali metal salt, and an optional additive component. In yet some additional embodiments, the coating composition comprises, consists essentially of, or consists of a DES, a metal precursor, an ionic liquid, an alkali metal salt, and an optional additive component. In yet some other embodiments, the coating composition comprises, consists essentially of, or consists of an ionic liquid, a metal precursor, an alkali metal salt, and an optional additive component.

The DES of the coating composition can comprise a single chemical species, or a mixture of two or more chemical species. In some embodiments, the DES comprises an organic salt, a hydrogen-bond donor compound, or a combination thereof. The organic salt can comprise a quaternary ammonium compound and a counterion. In particular embodiments, the counterion is a halide counterion (e.g., chloride, bromide, iodide, fluoride). In representative embodiments, the halide counterion is chloride or bromide. In yet additional embodiments, the counterion can be an organic counterion, such as acetate, bitartrate, or the like. The quaternary ammonium compound can be selected from choline, N-ethyl-2-hydroxy-N,N-dimethylethanaminium, 2-(chlorocarbonyloxy)-N,N,N-trimethylethanaminium, N-benzyl-2-hydroxy-N,N-dimethylethanaminium, or the like. In particular embodiments, the quaternary ammonium compound is choline and the counterion is chloride and thus the organic salt is choline chloride. In yet other embodiments, the quaternary ammonium compound is choline and the counterion is acetate and thus the organic salt is choline acetate. In yet additional embodiments, the quaternary ammonium compound is choline and the counterion is bromide and thus the organic salt is choline bromide. In yet additional embodiments, the quaternary ammonium compound is choline and the counterion is bitartrate and thus the organic salt is choline bitartrate. In some embodiments, the DES can comprise a hydrogen-bond donor compound, such as urea, acetamide, 1-methyl urea, 1,3-dimethyl urea, 1,1-dimethyl urea, thiourea, benzamide, glycerol, ethylene glycol, malonic acid, benzoic acid, adipic acid, oxalic acid, succinic acid, citric acid, acetic acid, or combinations thereof. In particular embodiments, the hydrogen-bond donor compound is ethylene glycol, acetic acid, or urea.

In particular embodiments, the DES comprises an organic salt and a hydrogen-bond donor compound. In representative examples of such embodiments, the DES can comprise choline chloride and ethylene glycol (also known as ethaline when the choline chloride and ethylene glycol are present at a ratio of 1:2); choline acetate and ethylene glycol; choline bitartrate and ethylene glycol; choline bromide and ethylene glycol; choline chloride and acetic acid; choline acetate and acetic acid; choline bitartrate and acetic acid; choline bromide and acetic acid; choline chloride and urea; choline acetate and urea; choline bitartrate and urea; choline bromide and urea. The amount of the organic salt and/or hydrogen-bond donor included in the DES can be selected to provide a suitable viscosity for the method embodiments disclosed herein. In some embodiments, the viscosity is not so viscous that atoms of components of the coating composition are immobilized when a voltage is applied. In some embodiments, the viscosity of the coating composition is typically such that it has a "watery" consistency such that atoms are able to be mobile when a voltage is applied. In particular embodiments, a desirable viscosity can be achieved in coating composition embodiments comprising a DES that comprises a combination of the organic salt to the hydrogen-bond donor component in a ratio ranging 1.9:1 to 2.1:1, such as 2.95:1 to 2.05:1, or 1.999:1 to 2.001:1. In particular embodiments, the DES comprises a ratio of organic salt:hydrogen-bond donor component of 1:2.

The metal precursor used in the coating composition can be selected from a metal precursor capable of providing a metal coating upon exposure to pulsed voltage and/or DC voltage. In particular embodiments, the metal precursor is one that can provide a refractory metal coating upon exposure to pulsed voltage and/or DC voltage. In some embodiments, the metal precursor can be a metal salt that includes a refractory metal and that can provide a metallic form of the refractory metal upon electroplating. In some embodiments, the refractory metal can be selected from Zr, Ti, V, Cr, Mn, Nb, Mo, Tc, Ru, Rh, Hf, Ta, W, Re, Os, or Ir. In particular embodiments, the metal precursor is a refractory metal halide. In some embodiments, the refractory metal halide is a fluoride or bromide salt of Zr, Ti, V, Cr, Mn, Nb, Mo, Tc, Ru, Rh, Hf, Ta, W, Re, Os, or Ir, including, but not limited to, pentafluoride salts, tetrafluoride salts, trifluoride salts, difluoride salts, pentabromide salts, tetrabromide salts, tribromide salts, and dibromide salts. In representative embodiments, the metal precursor can be selected from $ZrF_4$, $TiF_4$, $WF_4$, $NbF_4$, $NbF_5$, $TaF_3$, $TaF_5$, $HfF_4$, $VF_3$, $VF_4$, $IrF_4$, $IrF_5$, $ZrBr_4$, $TiBr_4$, $WBr_4$, $NbBr_4$, $NbBr_5$, $TaBr_3$, $TaBr_5$, $HfBr_4$, $VBr_3$, $VBr_4$, $IrBr_4$, or $IrBr_5$. Such metal precursors are either available from a commercial source or can be synthesized. In some embodiments, for example, titanium fluoride is prepared using $TiCl_4$. In such methods, trifluoroacetic acid ($CF_3CO_2H$) is added to a $TiCl_4$ solution to precipitate Ti(IV) trifluoroacetate ($Ti(CF_3CO_2)_4$). This precipitate can have waters of hydration; however, any waters of hydration can be removed by adding trifluoroacetic anhydride to the titanium trifluoroacetate. The dry $Ti(CF_3CO_2)_4$ can then be converted to $TiF_4$ via pyrolysis in an inert atmosphere or under vacuum. In yet other embodiments, a commercial source of $TiF_4$ can be dried (freed from any waters of hydration) in a similar manner by adding trifluoroacetic acid and trifluoroacetic anhydride to the commercial $TiF_4$ powder. This drying step results in a mixture of dry $TiF_4$ and dry $Ti(CF_3CO_2)_4$, which can be converted to entirely $TiF_4$ via pyrolysis. In an independent embodiment, the metal precursor does not comprise chromium (or is other than a chromium salt) or silver (or is other than a silver salt). In particular embodiments, the metal precursor that is used in the coating composition is present in an amount that is approximately 50% or greater than the amount of metallic component that is to be deposited on the substrate. In some embodiments, the metal precursor that is used in the coating composition is present in an amount ranging from greater than 0 nM to 0.5M, such as greater than 0.01 nM to 0.4M, or 0.1 nM to 0.33M, or 1 nM to 0.3M, or 1.5 nM to 0.25M.

In some embodiments, the coating composition can comprise an ionic liquid in addition to the DES. In independent embodiments, the coating composition can comprise an ionic liquid without a DES. In such embodiments, the ionic liquid can comprise a cationic component and an anionic component. The cationic component be a positively-charged compound comprising a quaternary substituted nitrogen atom or a tri-substituted sulfur atom. The anionic component can be a negatively-charged compound comprising di-substituted nitrogen atom. In particular embodiments, the cationic component can be an ammonium salt or a sulfonium salt and the anionic component can be a bis-substituted imide compound, such as bis(trifluoromethylsulfonyl)imide. In representative embodiments, the ionic liquid can comprise triethylsulfonium bis(trifluoromethylsulfonyl)imide, 1-butyl-3-methylpyridinium bis(trifluormethylsulfonyl) imide, methyl-trioctylammonium bis(trifluoromethylsulfonyl)imide, diethylmethyl(2-methoxyethyl)ammonium bis (trifluoromethylsulfonyl)imide, or any combination thereof. In coating composition embodiments comprising a combination of a DES and an ionic liquid, the two can be present in amounts that provide a ratio of DES:ionic liquid ranging from 19:1 to 1:19 (DES:ionic liquid), such as 15:1 to 1:15 (DES:ionic liquid), or 10:1 to 1:10 (DES:ionic liquid), or 5:1 to 1:5 (DES:ionic liquid), or 3:1 to 1:3 (DES:ionic liquid). In particular embodiments, the ratio can be 3:1 (DES:ionic liquid), or 2:1 (DES:ionic liquid), or 1:1 (DES:ionic liquid), or 1:2 (DES:ionic liquid), or 1:3 (DES:ionic liquid). In particular embodiments, the ratio of DES:ionic liquid is 3:1, 1:1, or 1:3. Images of Mo substrates comprising coatings formed from exemplary coating composition embodiments comprising different ratios of DES to ionic liquid are shown in FIGS. 3A-3E.

In some embodiments, the coating composition can comprise an alkali metal salt. In some embodiments, it can be an alkali metal salt comprising an alkali metal and a halide counterion. Alkali metals can be selected from Group 1 of the periodic table and can include lithium (Li), sodium (Na), potassium (K), rubidium (Rb), cesium (Cs), and francium (Fr). In particular embodiments, the halide counterion is a fluoride ion, a chloride ion, a bromide ion, or an iodide ion. In representative embodiments, the alkali metal salt is LiF, NaF, or another charge carrier. In particular embodiments, the alkali metal salt is present in an amount ranging from greater than 0 nM to 0.75M, such as greater than 0.01 nM to 0.6M, or 0.1 nM to 0.5M, or 1 nM to 0.4M, or 1.5 nM to 0.3M.

In yet some additional embodiments, the coating composition can comprise an optional additive component. The additive component can be used to modify the viscosity of the coating composition and/or to adjust the time it takes to plate the coating. In some embodiments, the additive component can be a urea, a pH-controlling reagent (e.g., a buffer, an acid, and/or a base), a reducing agent (e.g., lithium-based reducing agents, such as lithium aluminum hydride and the like), or combinations thereof.

Particular coating composition embodiments can comprise choline chloride; ethylene glycol; an ionic liquid selected from triethylsulfonium bis(trifluoromethylsulfonyl) imide, 1-butyl-3-methylpyridinium bis(trifluormethylsulfonyl)imide, methyl-trioctylammonium bis(trifluoromethylsulfonyl)imide, diethylmethyl(2-methoxyethyl)ammonium bis(trifluoromethylsulfonyl)imide, or any combination thereof; LiF; and $ZrF_4$ or $TiF_4$. In some additional embodiments, the coating composition can consist essentially of choline chloride; ethylene glycol; an ionic liquid selected from triethylsulfonium bis(trifluoromethylsulfonyl)imide, 1-butyl-3-methylpyridinium bis(trifluormethylsulfonyl) imide, methyl-trioctylammonium bis(trifluoromethylsulfonyl)imide, diethylmethyl(2-methoxyethyl)ammonium bis (trifluoromethylsulfonyl)imide, or any combination thereof; LiF; and $ZrF_4$ or $TiF_4$. In yet additional embodiments, the coating composition can consist of choline chloride; ethylene glycol; an ionic liquid selected from triethylsulfonium bis(trifluoromethylsulfonyl)imide, 1-butyl-3-methylpyridinium bis(trifluormethylsulfonyl)imide, methyl-trioctylammonium bis(trifluoromethylsulfonyl)imide, diethylmethyl (2-methoxyethyl)ammonium bis(trifluoromethylsulfonyl) imide, or any combination thereof; LiF; and $ZrF_4$ or $TiF_4$. In other embodiments, the coating composition can comprise choline chloride; ethylene glycol; LiF; and $ZrF_4$ or $TiF_4$. In some additional embodiments, the coating composition can consist essentially of choline chloride; ethylene glycol; LiF; and $ZrF_4$ or $TiF_4$. In yet additional embodiments, the coating composition can consist of choline chloride; ethylene glycol; LiF; and $ZrF_4$ or $TiF_4$. In other embodiments, the coating composition can comprise an ionic liquid selected from triethylsulfonium bis(trifluoromethylsulfonyl)imide, 1-butyl-3-methylpyridinium bis(trifluormethylsulfonyl) imide, methyl-trioctylammonium bis(trifluoromethylsulfonyl)imide, diethylmethyl(2-methoxyethyl)ammonium bis (trifluoromethylsulfonyl)imide, or any combination thereof; LiF; and $ZrF_4$ or $TiF_4$. In some additional embodiments, the coating composition can consist essentially of an ionic liquid selected from triethylsulfonium bis(trifluoromethylsulfonyl) imide, 1-butyl-3-methylpyridinium bis(trifluormethylsulfonyl)imide, methyl-trioctylammonium bis(trifluoromethylsulfonyl)imide, diethylmethyl(2-methoxyethyl)ammonium bis(trifluoromethylsulfonyl)imide, or any combination thereof; LiF; and $ZrF_4$ or $TiF_4$. In yet additional embodiments, the coating composition can consist of an ionic liquid selected from triethylsulfonium bis(trifluoromethylsulfonyl) imide, 1-butyl-3-methylpyridinium bis(trifluormethylsulfonyl)imide, methyl-trioctylammonium bis(trifluoromethylsulfonyl)imide, diethylmethyl(2-methoxyethyl)ammonium bis(trifluoromethylsulfonyl)imide, or any combination thereof; LiF; and $ZrF_4$ or $TiF_4$. In any or all of the above embodiments, coating compositions that consist essentially of the recited components typically do not comprise components or other materials that deleteriously affect the coating formed from the coating composition, such as by (but not limited to) preventing or inhibiting the ability of the metal precursor to be converted to the desired metal species, or preventing or inhibiting the ability of a thin coating of the metal to be formed, or preventing or inhibiting the ability to achieve a smooth coating of the metal. In some embodiments, such components can include glycolic acid or platinum.

In some embodiments, the coating composition can be made by combining the DES or the ionic liquid with the metal precursor and the alkali metal salt and any optional additive. In embodiments comprising a DES and an ionic liquid, the DES and the ionic liquid are first mixed, followed by metal precursor and alkali metal salt addition. The resulting composition can be sonicated for a suitable time period such that any solids are dissolved. In some embodiments, any water and/or air present in the coating composition can be removed by exposing the coating composition to an inert atmosphere and/or applying heat (e.g., 150° C.). Representative coating composition preparation methods are described in the Examples section.

Figure 4A:
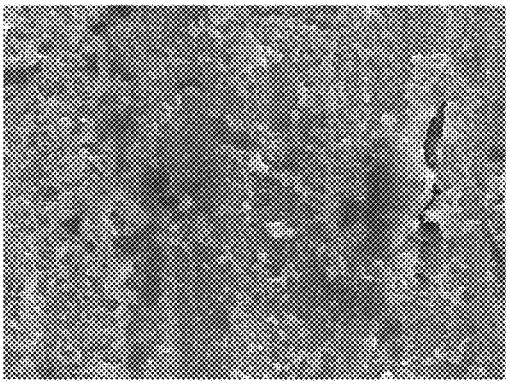
FIGS. 4A-4D are SEM images showing (i) a Zr coating on a Mo substrate obtained using a coating composition embodiment and a method embodiment of the present disclosure and wherein the Zr was deposited using DC plating (FIG. 4A); (ii) the same coating composition as FIG. 4A, but wherein the method used a pulsed voltage process (FIG. 4B); (iii) a view of the coated substrate showing the interface between the Zr coating and the Mo substrate (FIG. 4C); and (iv) a view of the Mo substrate without any Zr coating (FIG. 4D).
Figure 4B:
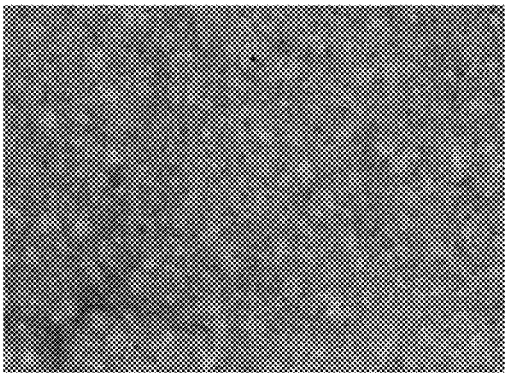
Figure 4C:
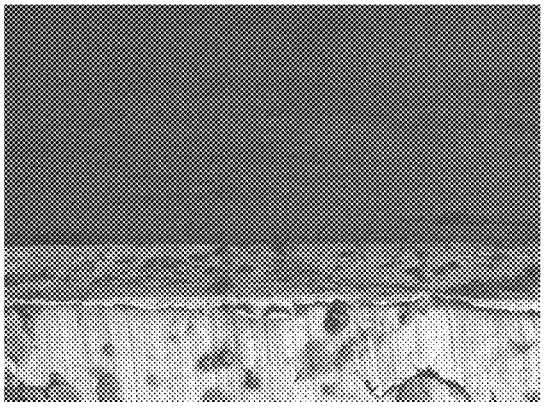
Figure 4D:
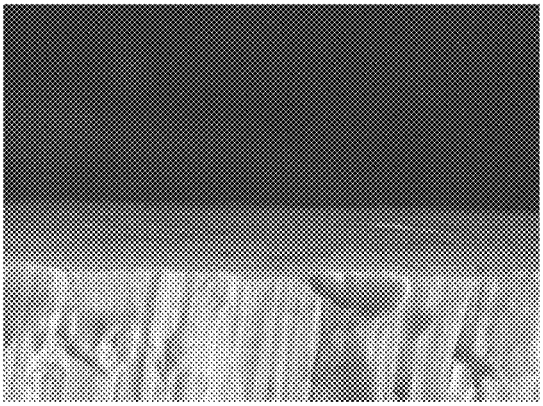
Figure 5A:
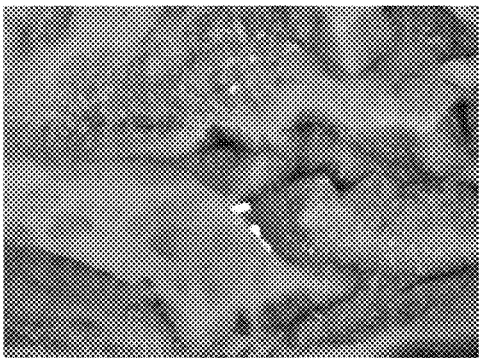
FIGS. 5A-5C are SEM images showing (i) a Zr coating on a Mo substrate obtained using a coating composition comprising a combination of a DES and an ionic liquid and wherein the Zr was deposited using pulsed voltage plating (FIG. 5A); (ii) a view of the coated substrate showing the interface between the Zr coating and the Mo substrate (FIG. 5B); and (iii) a Zr coating on a Mo substrate obtained using a coating composition comprising an ionic liquid without a DES and wherein the Zr was deposited using pulsed voltage plating (FIG. 5C).
Figure 5B:
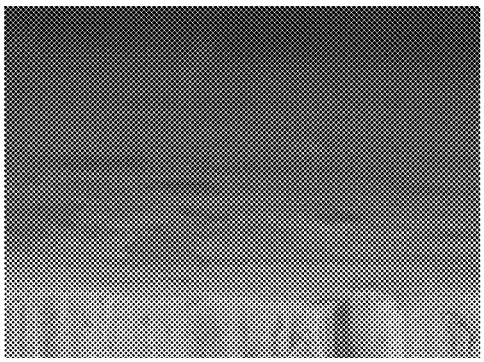
Figure 5C:
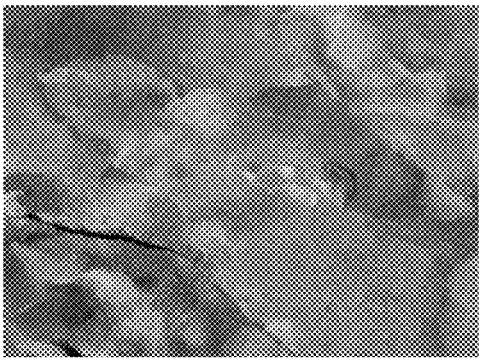

The method of forming a metal coating on a substrate using the coating composition embodiments disclosed herein can comprise exposing a substrate to the coating composition and applying a voltage to facilitate plating a metal from the metal precursor onto the substrate. In some embodiments, the voltage can be applied using either DC voltage or by applying a pulsed voltage protocol. The voltage that is used in the method can be selected depending on the type of metal precursor used in the coating composition and/or the desired metal to be coated on the substrate. Solely by way of example, in embodiments where a Zr precursor is used in the coating composition (so as to deposit a metallic Zr coating), the applied voltage used in the method can range from −3 V to 1 V, such as −2.5 V to −0.5 V, or −2V to −0.5 V, or −1.9 V to −0.5 V, or −1.8 to −1 V. In some embodiments, the metallic zirconium is deposited using voltages of −1.85 V to −1.81 V, such as −1.84 V. In embodiments using a Ti precursor, applied voltage used in the method can range from −2.2 V to 1 V, such as −2.2 V to −1 V, or −2.2 V to −1.5 V. In some embodiments, the Ti metal is deposited using voltage of −2.2 V to −1.5 V, such as −1.65 V. In some embodiments, the voltage can be applied using a pulsed voltage protocol. In such embodiments, the pulsed voltage protocol can comprise using one or more timed intervals where voltage turned on and off for specified periods of time. In some exemplary embodiments, a pulse plating protocol involves applying a voltage for 100 ms and then providing a 10 ms rest where no voltage is applied. These on/off voltage intervals can be repeated for a suitable amount of time to provide a desired coating thickness, which is discussed more below. In some embodiments, the pulsed voltage protocol is carried out for one hour. Without being limited to a single theory, it currently is believed that using a pulsed voltage protocol can facilitate removing contamination from the substrate and/or coating formed thereof and can facilitate ion diffusion during the process. FIGS. 4A-4C, 5A and 5B provide SEM images of coating morphological features observed for coatings made using certain coating composition embodiments disclosed herein and method embodiments using DC voltage or pulsed voltage, along with an SEM image of an uncoated substrate (FIG. 4D) and a coating formed using solely an ionic liquid (without any DES) (FIG. 5C).

In particular embodiments, the method is carried out at temperatures ranging from 19° C. to 150° C., such as 20° C. to 140° C. or 25° C. to 125° C. The disclosed coating composition embodiments and method embodiments are thus able to avoid the high temperatures typically required by conventional methods that use molten salt-based coating compositions, such as temperatures of 400° C. or higher, such as 400° C. to 600° C., and thus can preserve energy and thus result in energy/cost savings when compared to conventional methods using higher temperatures. In some embodiments, the method is carried out at ambient temperature, such as at temperatures ranging from 19° C. to 26° C., such as 20° C. to 25° C., or 21° C. to 25° C. At least one non-limiting benefit of using ambient temperatures in some embodiments is that the lifetime of the coating composition can be maintained for a good period of time, which can also facilitate continuous coating deposition because the coating composition can be used over several coating cycles and/or can even be reused. In some embodiments, the lifetime of the coating composition is 6 hours or more. In some independent embodiments, the method can be carried out at higher temperatures, such as at temperatures ranging from greater than 26° C. to 130° C., such as 30° C. to 125° C., or 50° C. to 125° C.

In some embodiments, the method can be used to deposit metal coatings, such as refractory metal coatings, on various types of substrates. In some embodiments, the substrate can be an electrically conductive substrate. In some embodiments, the substrate can be a metal substrate, such as a Mo substrate, a copper (Cu) substrate, a Zr substrate, a steel substrate, a uranium (U) substrate, an aluminum (Al) substrate, a gold (Au) substrate, or substrates comprising combinations of any such materials. In particular examples, the substrate is a Mo substrate, a Cu substrate, a Zr substrate, or a U-Mo substrate (e.g., U-10% Mo substrates).

Figure 6:
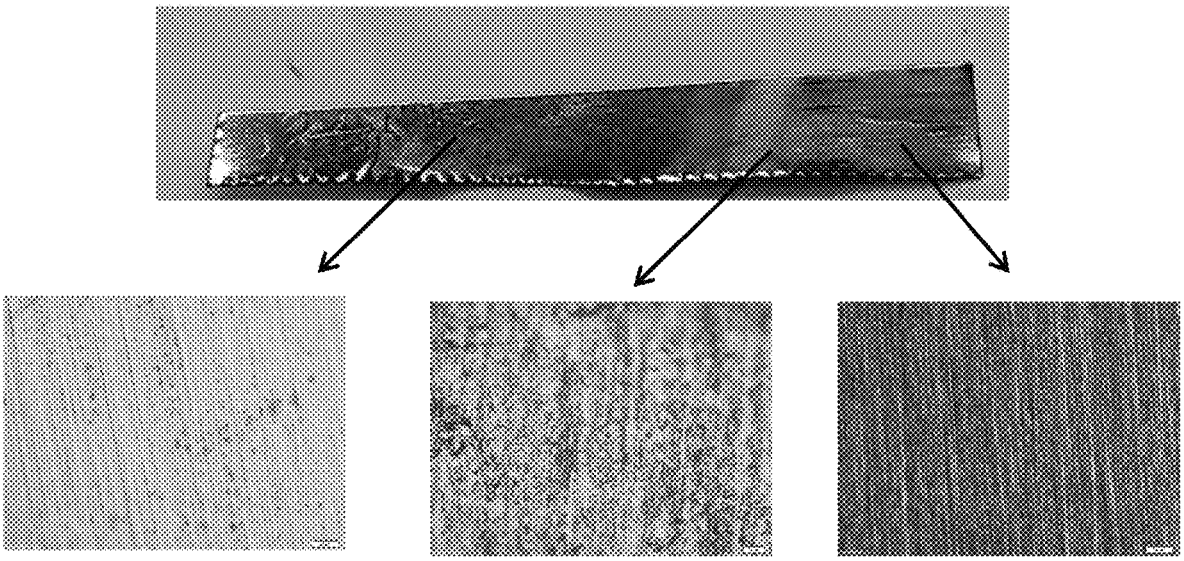
FIG. 6 provides a photographic image of a Mo substrate comprising a Zr coating on a portion thereof and corresponding optical microscopic images of different portions of the Mo substrate, including an uncoated portion (left optical image); a portion comprising the interface between the coating composition and the Mo substrate (middle image); and a portion comprising the Zr coating (right image).
Figure 7A:
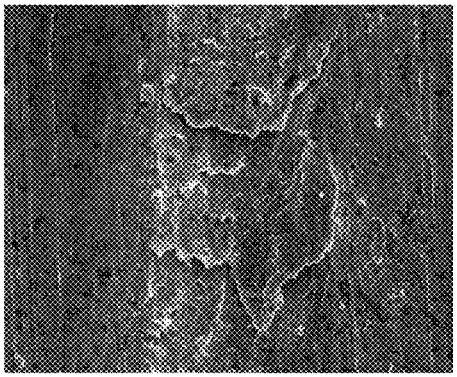
FIGS. 7A and 7B are SEM micrographs of a particular region of the portion of the Mo substrate from FIG. 6 comprising the Zr coating (FIG. 7A) and a particular region of the region analyzed in FIG. 7A that was analyzed for elemental constituents (FIG. 7B).
Figure 7B:
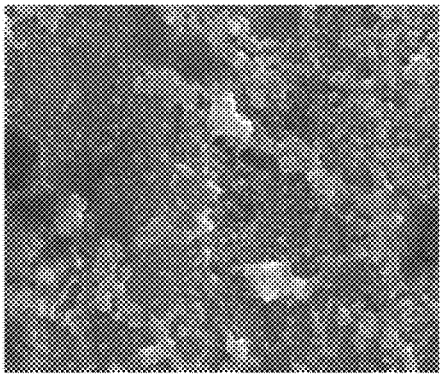

Method embodiments disclosed herein can be used to deposit metal coatings on substrates, such as those described above. In some embodiments, the metal coating can fully or partially coat the surface area of the substrate. For example, in some embodiments, for any particular amount of surface area that is desired to be coated with a metal using the coating composition can be coated such that more than 80% to 100% of that desired surface area can be coated with the metal, such as greater than 80% to 100%, or 90% to 100%, or 95% to 100%, or 98% to 100%. In particular examples, such as the embodiment illustrated in FIG. 6, metal deposition coverage was observed to be >99.9±0.4% of the surface area of the substrate that was exposed to the coating composition. FIGS. 7A and 7B are SEM images taken from a region of the coated portion of the substrate in FIG. 6.

Figure 8A:
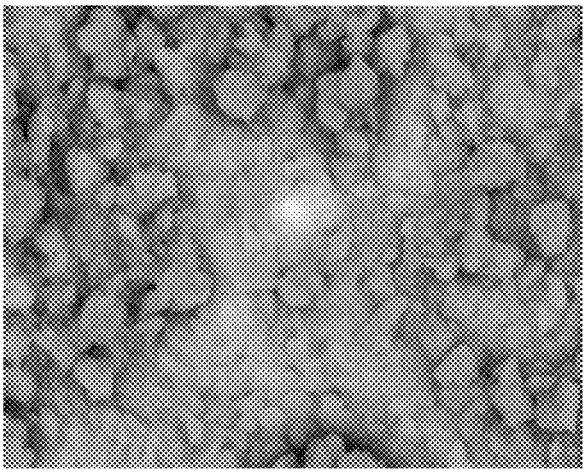
FIGS. 8A and 8B are SEM micrographs of a Zr coating obtained using a coating composition and method embodiment disclosed herein (FIG. 8A); and the Mo substrate on which the Zr coating of FIG. 8A was deposited (FIG. 8B).
Figure 8B:
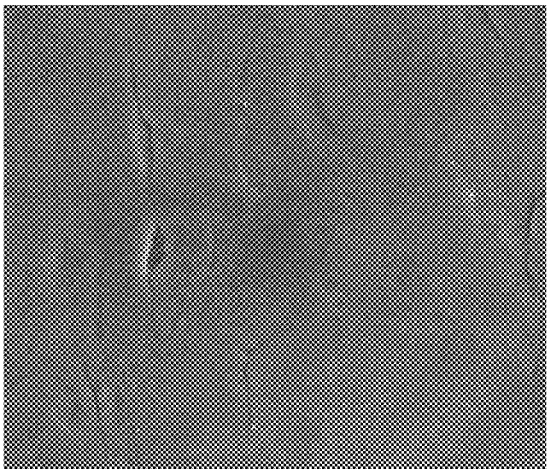

The metal coating typically is deposited as an even coating over the desired surface area of the substrate as opposed to a coating comprising patches of the metal material that is deposited randomly (or unevenly) over the desired surface area. In some embodiments, the metal coating can be an evenly deposited (e.g., conformal) coating in the sense that there is minimal exposed surface area of the substrate after the coating has been deposited. For example, an even coating that can be formed with minimal exposed substrate surface area using coating composition and method embodiments of the present disclosure is shown by FIG. 8A (with FIG. 8B providing an SEM of the uncoated Mo substrate). As can be seen in FIG. 8A, the coating composition embodiment, which comprised a DES, provided an even coating of metallic zirconium on the Mo substrate (FIG. 8B) leaving little to no exposed regions of the Mo substrate (see FIG. 8A). In some embodiments, the coating can be slightly porous, with particular embodiments exhibiting a porosity ranging from 0.01% to 0.1%. In some embodiments, grains having sizes ranging from 30 to 50 nm can be present.

In some embodiments, the integrity and/or physical features of the coating provided by the coating composition and method embodiments of the present disclosure can be measured. Such measurements can involve using X-ray fluorescence (XRS) to determine atomic composition of a coating; scanning electron microscopy (SEM) to evaluate coating thickness; optical microscopy to evaluate coating uniformity; energy dispersive spectroscopy (EDS) to evaluate the chemical make-up of the coating; X-ray photoelectron spectroscopy (XPS) to evaluate surface states and chemistry; X-ray diffraction (XRD) to evaluate the crystallinity and composition of the coating; and/or oxidation experiments to determine coating thickness, variation, and/or to confirm the presence of the coating. Some such techniques are discussed below.

Figure 9:
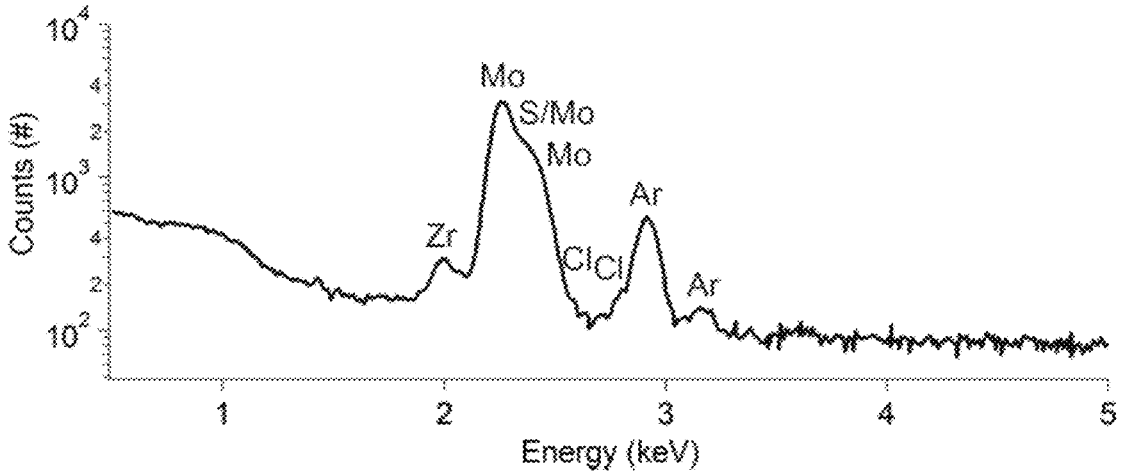
FIG. 9 is an X-ray fluorescence (XRS) spectrum obtained from analyzing a Mo substrate comprising a Zr coating formed using a coating composition embodiment and method embodiment disclosed herein.
Figure 10:
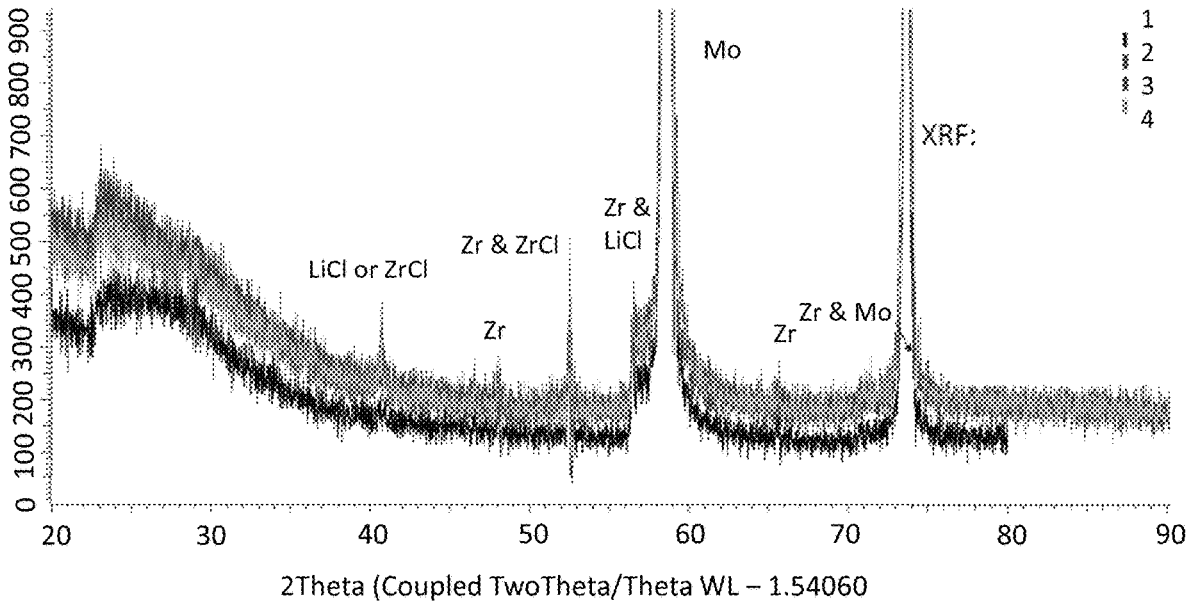
FIG. 10 is an X-ray dispersion (XRD) spectrum showing results obtained from analyzing a Mo substrate comprising a Zr coating provided by a coating composition embodiment and a method embodiment of the present disclosure and using pulsed voltage plating.

An XRS spectrum for a particular coating made using a coating composition and method embodiment of the present disclosure is provided by FIG. 9, which shows that the Mo signal provided by the Mo substrate diminishes due to the deposited Zr coating and further shows that the Zr coating is stable. An XRD spectrum for a particular coating made using a coating composition and method embodiment of the present disclosure is provided by FIG. 10. FIGS. 9 and 10 also corroborate that there are minimal contaminants present in the coating, such as sulfur and chloride contaminants. In the embodiment of FIG. 9, the amount of sulfur was low (0.1% to 2%), as was the intermittent observed chloride (0.1% to 0.3%). As such, yet another benefit provided by embodiments of the disclosed coating composition and method is the ability to obtain coating embodiments that are substantially free of contaminants. Contaminants can include sulfur, metal chlorides (e.g., lithium chlorides, zirconium chlorides, and titanium chlorides), metal oxides (e.g., lithium oxide, zirconium oxide, titanium oxide), and/or sulfides (e.g., lithium sulfides, zirconium sulfides, and titanium sulfides).

Figure 11A:
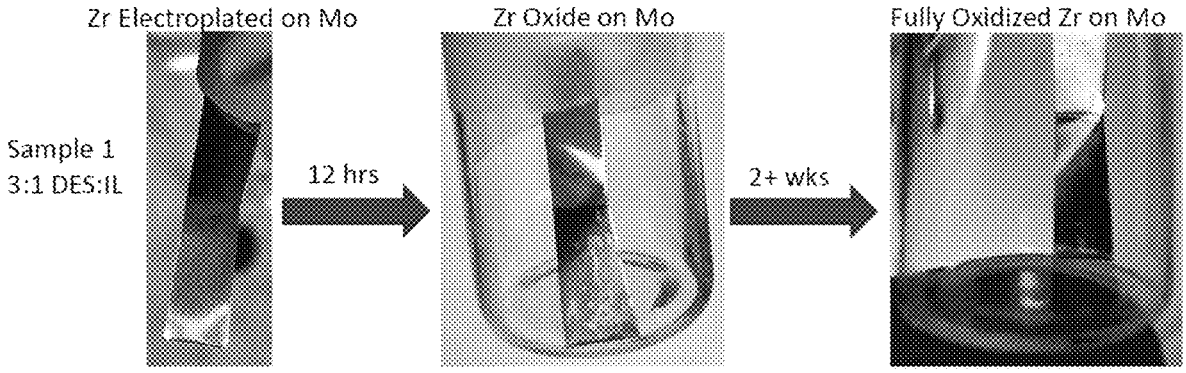
FIGS. 11A-11C provides images showing the progress of an oxidation test wherein the sample was left in an oxidative environment (progress shown by FIG. 11A) and wherein the results confirmed the presence of a metallic zirconium coating obtained using a coating composition and method embodiment disclosed herein (FIGS. 11B and 11C).
Figure 11B:
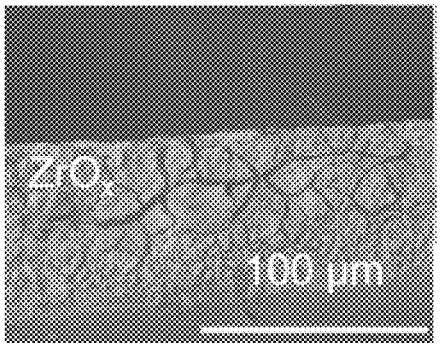
Figure 11C:
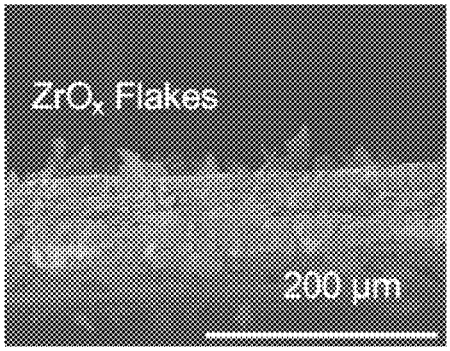

In some embodiments, oxidation experiments can be conducted to confirm that a coating has been formed on the substrate from the coating composition. In such embodiments, a coated substrate can be exposed to an oxygenated environment and if the coating is present, it can be oxidized and can exhibit changes in visual appearance (such as can be seen by comparing the left, middle, and right images of FIG. 11A, where, as time spent under the oxygenated environment progresses and further oxidation occurs, the coating of the substrate becomes dark and dull) and/or can exhibit changes in coating integrity as determined using SEM (as can be seen by FIGS. 11B and 11C where zirconium oxides are formed as time under the oxygenated environment progresses and begin to flake away from the substrate).

Figure 12:
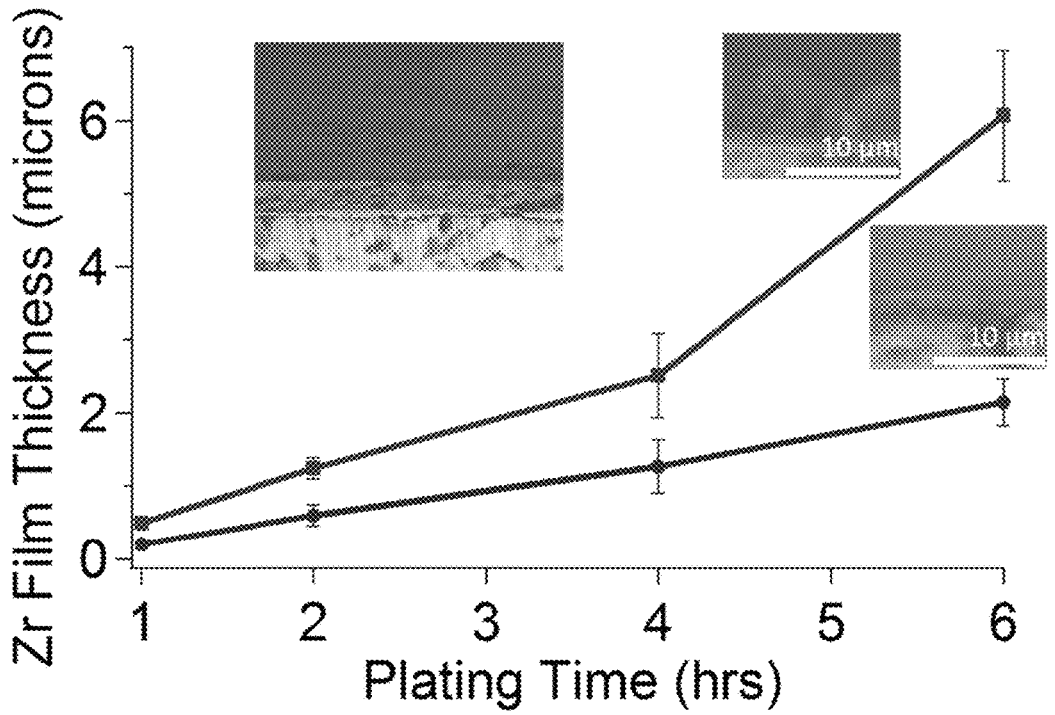
FIG. 12 is a graph of Zr coating thickness (microns) as a function of plating time (hours) obtained for several samples operated at different temperatures (125° C. and 25° C.) shows that coating thickness can be increased by increasing plating time.

In some embodiments, thin coatings can be provided using coating composition and method embodiments of the present disclosure. In some embodiments, the coating composition and method of the present disclosure can be used to provide a coating having a thickness of greater than 0 nanometers to 100 microns, such as greater than 0 nanometers to 80 microns, or 1 micron to 75 microns, or 2 microns to 65 microns, or 3 microns to 50 microns or 4 microns to 40 microns, or 5 microns to 30 microns or 6 microns to 20 microns. In some embodiments, substrates comprising a thin coating of the metal component are desirable in certain industries and can be made using coating composition and method embodiments disclosed herein. In particular embodiments described herein, a coating having a thickness of 10 microns or less can be obtained (e.g., 8 microns or less, 7 microns or less, or 6 microns or less). Coating thickness can be controlled by modifying the temperature and/or plating time used in the method. Results from an exemplary embodiment wherein plating times of 1 to 6 hours were evaluated at two different temperatures (25° C. and 125° C.) are provided by FIG. 12. In some embodiments, thin coats could be obtained at ambient temperature using plating time periods ranging from 2 hours to 6 hours or more.

In particular embodiments of the method, the coating composition and the substrate are enclosed in a container during the method. The container can be maintained under an inert atmosphere. In some embodiments, the container can be an electrochemical cell (e.g., a cell comprising a combination of inlets and/or outlets suitable for introducing one or more electrodes into the cell, such as working, reference, and/or counter electrodes; purging and/or blanketing the contents in the cell, and/or for temperature sensing, reagent addition, and/or venting). In some embodiments, the substrate used in the method can be pretreated by cleaning the substrate with an alcohol solution and then allowing the substrate to dry, or by using an acid etching process, or by an abrasion process. In yet some additional embodiments, the method can further comprise post-treating the coated substrate. In some such embodiments, the post-treatment can comprise treating the coated substrate with an alcohol solution and/or sonication and then allowing the coated substrate to dry under an inert atmosphere (e.g., $N_2$ or Ar).

In some embodiments, the coating composition embodiments and method embodiments of the present disclosure provide unexpectedly superior coatings on substrates. For example, in some embodiments, the coating composition comprises a DES that contains a chloride-containing species (e.g., choline chloride) which, contrary to conventional wisdom in the art, facilitates providing the metal coating from the metal precursor. For example, it is generally known in the art that metallic zirconium coatings are difficult to produce using electrodeposition in plating solutions that comprise zirconium molten salts and chloride-containing reagents because the molten salt will preferentially form $ZrCl_3$ salts. In contrast to this conventional wisdom, however, the present inventors determined that coating composition embodiments disclosed herein could successfully provide metal coatings, such as zirconium coatings, even when using chloride-containing reagents, such as choline chloride. Additionally, in some independent embodiments, the present inventors are able to deposit metallic forms of refractory metals (e.g., metallic zirconium, metallic titanium, and the like) even using coating composition embodiments that use an ionic liquid without a DES.

Overview of Several Embodiments

Disclosed herein are embodiments of a coating composition, comprising: a deep eutectic solvent comprising an organic salt, a hydrogen-bond donor compound, or a combination thereof; an ionic liquid; a metal precursor; and an alkali metal salt.

In some embodiments, the deep eutectic solvent comprises a mixture of the organic salt and the hydrogen-bond donor. In some embodiments, the organic salt comprises a quaternary ammonium compound and a counterion selected from a halide, an acetate, or a bitartrate.

In any or all of the above embodiments, the quaternary ammonium compound is selected from choline, N-ethyl-2-hydroxy-N,N-dimethylethanaminium, 2-(chlorocarbonyloxy)-N,N,N-trimethylethanaminium, N-benzyl-2-hydroxy-N,N-dimethylethanaminium.

In any or all of the above embodiments, the counterion is a halide selected from a chloride or a bromide.

In any or all of the above embodiments, the hydrogen-bond donor compound is selected from urea, acetamide, 1-methyl urea, 1,3-dimethyl urea, 1,1-dimethyl urea, thiourea, benzamide, glycerol, ethylene glycol, malonic acid, benzoic acid, adipic acid, oxalic acid, succinic acid, citric acid, acetic acid, or combinations thereof.

In any or all of the above embodiments, the deep eutectic solvent comprises choline chloride, choline bromide, choline acetate, choline bitartrate, or a combination thereof; and urea, acetamide, 1-methyl urea, 1,3-dimethyl urea, 1,1-dimethyl urea, thiourea, benzamide, glycerol, ethylene glycol, malonic acid, benzoic acid, adipic acid, oxalic acid, succinic acid, citric acid, acetic acid, or combinations thereof.

In any or all of the above embodiments, the deep eutectic solvent comprises choline chloride and ethylene glycol. In some embodiments, the choline chloride and ethylene glycol are present in a ratio ranging from 1:3 choline chloride: ethylene glycol to 3:1 choline chloride:ethylene glycol.

In any or all of the above embodiments, the ionic liquid comprises a cationic component and an anionic component, wherein the cationic component is a positively-charged compound comprising a quaternary substituted nitrogen atom or a tri-substituted sulfur atom and the anionic component is a bis-substituted imide compound.

In any or all of the above embodiments, the ionic liquid is selected from triethylsulfonium bis(trifluoromethylsulfonyl)imide, 1-butyl-3-methylpyridinium bis(trifluormethylsulfonyl)imide, methyl-trioctylammonium bis(trifluoromethylsulfonyl)imide, diethylmethyl(2-methoxyethyl) ammonium bis(trifluoromethylsulfonyl)imide, or a combination thereof.

In any or all of the above embodiments, the metal precursor is a refractory metal salt compound comprising a refractory metal selected from Zr, Ti, V, Cr, Mn, Nb, Mo, Tc, Ru, Rh, Hf, Ta, W, Re, Os, or Ir and halide selected from a fluoride or a bromide.

In any or all of the above embodiments, the metal precursor is selected from $ZrF_4$, $TiF_4$, $WF_4$, $NbF_4$, $NbF_5$, $TaF_3$, $TaF_5$, $HfF_4$, $VF_3$, $VF_4$, $IrF_4$, $IrF_5$, $ZrBr_4$, $TiBr_4$, $WBr_4$, $NbBr_4$, $NbBr_5$, $TaBr_3$, $TaBr_5$, $HfBr_4$, $VBr_3$, $VBr_4$, $IrBr_4$, or $IrBr_5$.

In any or all of the above embodiments, the metal precursor is $ZrF_4$.

In any or all of the above embodiments, the metal precursor is $TiF_4$.

In any or all of the above embodiments, the alkali metal salt is LiF.

In any or all of the above embodiments, the coating composition further comprises an additive component selected from urea, a pH-controlling reagent, or a reducing agent.

Also disclosed herein are embodiments of a coating composition, comprising: a deep eutectic solvent, an ionic liquid, or a combination thereof a zirconium precursor; and an alkali metal salt.

In some embodiments, the deep eutectic solvent is a mixture of choline chloride and ethylene glycol; the ionic liquid is selected from triethylsulfonium bis(trifluoromethylsulfonyl)imide, 1-butyl-3-methylpyridinium bis(trifluormethylsulfonyl)imide, methyl-trioctylammonium bis(trifluoromethylsulfonyl)imide, diethylmethyl(2-methoxyethyl) ammonium bis(trifluoromethylsulfonyl)imide, or a combination thereof; the zirconium precursor is $ZrF_4$; and the alkali metal salt is LiF.

Also disclosed herein are embodiments of a coating composition, comprising: a deep eutectic solvent, an ionic liquid, or a combination thereof; a titanium precursor; and an alkali metal salt.

In some embodiments, the deep eutectic solvent is a mixture of choline chloride and ethylene glycol; the ionic liquid is selected from triethylsulfonium bis(trifluoromethylsulfonyl)imide, 1-butyl-3-methylpyridinium bis(trifluormethylsulfonyl)imide, methyl-trioctylammonium bis(trifluoromethylsulfonyl)imide, diethylmethyl(2-methoxyethyl) ammonium bis(trifluoromethylsulfonyl)imide, or a combination thereof; the titanium precursor is $TiF_4$; and the alkali metal salt is LiF.

Also disclosed herein are embodiments of a method, comprising: combining a coating composition according to any or all of the above embodiments with a substrate in a cell comprising one or more electrodes; and exposing the cell to a voltage using the one or more electrodes to thereby deposit a metal coating on the substrate from the coating composition.

In some embodiments, the substrate is a Mo substrate, a Cu substrate, a Zr substrate, a steel substrate, a U substrate, an Al substrate, or a substrate comprising any combination of Mo, Cu, Zr, U, steel, or Al.

In any or all of the above embodiments, in the voltage is a DC voltage or a pulsed voltage.

In any or all of the above embodiments, the voltage is applied as a pulsed voltage such that voltage is applied at a timed interval. In some embodiments, the timed interval comprises a 100 ms time period where voltage is applied and a 10 ms time period where no voltage is applied and wherein the timed interval is repeated at least two times.

In any or all of the above embodiments, the cell is maintained at a temperature ranging from ambient temperature to 150° C.

In any or all of the above embodiments, the coating composition comprises $ZrF_4$ as the metal precursor.

In any or all of the above embodiments, the coating composition comprises $TiF_4$ as the metal precursor.

EXAMPLES

Example 1

In this example, a coating composition comprising ethaline, LiF, and $ZrF_4$ was prepared. The ethaline was drawn with a pipette and injected into a new glass vial. A glass stir bar was added and the vial was sealed with a rubber needle septum. Two hypodermic needles were injected into the headspace above the liquid. One needle carried argon gas flow and the other vacuum. The argon flow injected Ar by gas jet into the liquid. The pressure was maintained always below 1 atm (~0.95 atm) to not build pressure in the system. The liquid was heated in this way to 150° C. for 24 to 72 hours to remove water and oxygen from within the system under high stir. $ZrF_4$ and LiF salts were ground with a pistol and mortar until fine prior to addition. Both salts were added to a clean glass vial with a glass stir bar. The vial was sealed with a rubber septum and evacuated. 4 mL of the mixture of DES and ionic liquid was added to the salts by needle injection. The mix was vortexed on high for 1 minute and sonicated under a 20 kHz bath sonicator for 1 hour. The solution was then evacuated for 1 hour under stir to remove any water or air that had inadvertently entered the coating composition's vial. In particular embodiments, $ZrF_4$ was added to bring the final concentration to 0.25 M and LiF was added in a similar way to a concentration of 0.5 M.

Example 2

In this example, a coating composition comprising ethaline, 1-butyl-1-methylpyrrolidinium bis(trifluoromethylsulfonyl)imide, LiF, and $ZrF_4$ was prepared. The ethaline and 1-butyl-1-methylpyrrolidinium bis(trifluoromethylsulfonyl)imide were drawn with a pipette and injected into a new glass vial. A glass stir bar was added and the vial was sealed with a rubber needle septum. Two hypodermic needles were injected into the headspace above the liquid. One needle carried argon gas flow and the other vacuum. The argon flow injected Ar by gas jet into the liquid. The pressure was maintained always below 1 atm (~0.95 atm) to not build pressure in the system. The liquid was heated in this way to 150° C. for 24 to 72 hours to remove water and oxygen from within the system under high stir. $ZrF_4$ and LiF salts were ground with a pistol and mortar until fine prior to addition. Both salts were added to a clean glass vial with a glass stir bar. The vial was sealed with a rubber septum and evacuated. 4 mL of the mixture of DES and ionic liquid was added to the salts by needle injection. The mix was vortexed on high for 1 minute and sonicated under a 20 kHz bath sonicator for 1 hour. The solution was then evacuated for 1 hour under stir to remove any water or air that had inadvertently entered the coating composition's vial. In particular embodiments, $ZrF_4$ was added to bring the final concentration to 0.25 M and LiF was added in a similar way to a concentration of 0.5 M.

Example 3

In this example, a coating composition comprising ethaline, methyl-trioctylammonium bis(trifluoromethylsulfonyl)imide, LiF, and $ZrF_4$ was prepared. The ethaline and methyl-trioctylammonium bis(trifluoromethylsulfonyl)imide were drawn with a pipette and injected into a new glass vial. A glass stir bar was added and the vial was sealed with a rubber needle septum. Two hypodermic needles were injected into the headspace above the liquid. One needle carried argon gas flow and the other vacuum. The argon flow injected Ar by gas jet into the liquid. The pressure was maintained always below 1 atm (~0.95 atm) to not build pressure in the system. The liquid was heated in this way to 150° C. for 24 to 72 hours to remove water and oxygen from within the system under high stir. $ZrF_4$ and LiF salts were ground with a pistol and mortar until fine prior to addition. Both salts were added to a clean glass vial with a glass stir bar. The vial was sealed with a rubber septum and evacuated. 4 mL of the mixture of DES and ionic liquid was added to the salts by needle injection. The mix was vortexed on high for 1 minute and sonicated under a 20 kHz bath sonicator for 1 hour. The solution was then evacuated for 1 hour under stir to remove any water or air that had inadvertently entered the coating composition's vial. In particular embodiments, $ZrF_4$ was added to bring the final concentration to 0.25 M and LiF was added in a similar way to a concentration of 0.5 M.

Example 4

In this example, a coating composition comprising ethaline, diethylmethyl(2-methoxyethyl)ammonium bis(trifluoromethylsulfonyl)imide, LiF, and $ZrF_4$ was prepared. The ethaline and diethylmethyl(2-methoxyethyl)ammonium bis(trifluoromethylsulfonyl)imide were drawn with a pipette and injected into a new glass vial. A glass stir bar was added and the vial was sealed with a rubber needle septum. Two hypodermic needles were injected into the headspace above the liquid. One needle carried argon gas flow and the other vacuum. The argon flow injected Ar by gas jet into the liquid. The pressure was maintained always below 1 atm (~0.95 atm) to not build pressure in the system. The liquid was heated in this way to 150° C. for 24 to 72 hours to remove water and oxygen from within the system under high stir. $ZrF_4$ and LiF salts were ground with a pistol and mortar until fine prior to addition. Both salts were added to a clean glass vial with a glass stir bar. The vial was sealed with a rubber septum and evacuated. 4 mL of the mixture of DES and ionic liquid was added to the salts by needle injection. The mix was vortexed on high for 1 minute and sonicated under a 20 kHz bath sonicator for 1 hour. The solution was then evacuated for 1 hour under stir to remove any water or air that had inadvertently entered the coating composition's vial. In particular embodiments, $ZrF_4$ was added to bring the final concentration to 0.25 M and LiF was added in a similar way to a concentration of 0.5 M.

Example 5

In this example, a coating composition comprising ethaline, triethylsulfonium bis(trifluoromethylsulfonyl)imide, LiF, and $ZrF_4$ was prepared. The ethaline and triethylsulfonium bis(trifluoromethylsulfonyl)imide were drawn with a pipette and injected into a new glass vial. A glass stir bar was added and the vial was sealed with a rubber needle septum. Two hypodermic needles were injected into the headspace above the liquid. One needle carried argon gas flow and the other vacuum. The argon flow injected Ar by gas jet into the liquid. The pressure was maintained always below 1 atm (~0.95 atm) to not build pressure in the system. The liquid was heated in this way to 150° C. for 24 to 72 hours to remove water and oxygen from within the system under high stir. $ZrF_4$ and LiF salts were ground with a pistol and mortar until fine prior to addition. Both salts were added to a clean glass vial with a glass stir bar. The vial was sealed with a rubber septum and evacuated. 4 mL of the mixture of DES and ionic liquid was added to the salts by needle injection. The mix was vortexed on high for 1 minute and sonicated under a 20 kHz bath sonicator for 1 hour. The solution was then evacuated for 1 hr under stir to remove any water or air that had inadvertently entered the coating composition's vial. In particular embodiments, $ZrF_4$ was added to bring the final concentration to 0.25 M and LiF was added in a similar way to a concentration of 0.5 M.

Example 6

In this example, a molybdenum (Mo) substrate was coated with the coating composition of Example 1. Coupons of Mo were cut to 0.5×4 cm widths from metal foils sheets. The coupons were then abrasively cleaned with a brillo pad for 30 seconds and cleaned under a nitrogen jet to remove fines. The coupons were then sealed in glass vials under argon and numbered with the same number as their intended coating composition.

Coating compositions in sealed containers with rubber septa lids were inserted into the exchange chamber of the glove bag along with the containers containing the metal coupon(s) as well as any other tools used for the plating. The argon flow was turned on to the glove bag and purged for 30 minutes at an overpressure of 0.2 psi. The containers of coating composition and coupons were inserted into the glove bag and the coating composition was poured (~4 ml) into the 5-neck electroplating flask (a Gamry "Dr. Bob" cell). The coating composition was heated to the desired temperature (20-125° C.), as was set to stir at 1200 RPM until heated at which time the stir was reduced to 60 RPM. The argon cover gas and bubbler were turned on and used to purify any contaminates (e.g., water) that remained in the coating composition. The cover gases were left on at all times during plating and were used to remove plating off-gasses and keep all oxygen away from the coating composition. The gases were used at all times and were the last things to be turned off in the setup. The Mo substrate was sonicated in alcohol for 60 seconds and then allowed to dry in the ambient Ar environment of the bag. The metal coupon was inserted into the custom clip electrode (or Gamry electrode holder) and placed in the center neck of the plating cell. This electrode is termed the "working electrode". The other 4 necks comprised: the bubbler and cover gas manifold, the reference electrode, the counter electrode, and the gas outlet. In some examples, the counter electrode is glassy carbon; however, Pt alloys and/or graphite electrodes can be used. The plating program is turned on and the plating commences (either DC or pulsed plating) for the desired time (e.g., 0-6 hours). The program then turns the voltage to −1.84. The program runs to completion and the hardware automatically shuts off. The coupon(s) was then removed from the coating composition and allowed to cool. It is then rinsed in isopropyl alcohol and sonicated (20 kHz) in same for 5 minutes. The coupon is dried in argon and sealed in a fresh glass container under argon for analysis. The above procedure was repeated using Zr and Cu substrates.

Example 7

In this example, a molybdenum (Mo) substrate was coated with the coating composition of Example 2. Coupons of Mo were cut to 0.5×4 cm widths from metal foils sheets. The coupons were then abrasively cleaned with a brillo pad for 30 seconds and cleaned under a nitrogen jet to remove fines. The coupons were then sealed in glass vials under argon and numbered with the same number as their intended coating composition.

Coating compositions in sealed containers with rubber septa lids were inserted into the exchange chamber of the glove bag along with the containers containing the metal coupon(s) as well as any other tools used for the plating. The argon flow was turned on to the glove bag and purged for 30 minutes at an overpressure of 0.2 psi. The containers of coating composition and coupons were inserted into the glove bag and the coating composition was poured (~4 ml) into the 5-neck electroplating flask (a Gamry "Dr. Bob" cell). The coating composition was heated to the desired temperature (20-125° C.), as was set to stir at 1200 RPM until heated at which time the stir was reduced to 60 RPM. The argon cover gas and bubbler were turned on and used to purify any contaminates (e.g., water) that remained in the coating composition. The cover gases were left on at all times during plating and were used to remove plating off-gasses and keep all oxygen away from the coating composition. The gases were used at all times and were the last things to be turned off in the setup. The Mo substrate was sonicated in alcohol for 60 seconds and then allowed to dry in the ambient Ar environment of the bag. The metal coupon was inserted into the custom clip electrode (or Gamry electrode holder) and placed in the center neck of the plating cell. This electrode is termed the "working electrode". The other 4 necks comprised: the bubbler and cover gas manifold, the reference electrode, the counter electrode, and the gas outlet. In some examples, the counter electrode is glassy carbon; however, Pt alloys and/or graphite electrodes can be used. The plating program is turned on and the plating commences (either DC or pulsed plating) for the desired time (e.g., 0-6 hours). The program then turns the voltage to −1.84. The program runs to completion and the hardware automatically shuts off. The coupon(s) was then removed from the coating composition and allowed to cool. It is then rinsed in isopropyl alcohol and sonicated (20 kHz) in same for 5 minutes. The coupon is dried in argon and sealed in a fresh glass container under argon for analysis. The above procedure was repeated using Zr and Cu substrates.

Example 8

In this example, a molybdenum (Mo) substrate was coated with the coating composition of Example 3. Coupons of Mo were cut to 0.5×4 cm widths from metal foils sheets. The coupons were then abrasively cleaned with a brillo pad for 30 seconds and cleaned under a nitrogen jet to remove fines. The coupons were then sealed in glass vials under argon and numbered with the same number as their intended coating composition.

Coating compositions in sealed containers with rubber septa lids were inserted into the exchange chamber of the glove bag along with the containers containing the metal coupon(s) as well as any other tools used for the plating. The argon flow was turned on to the glove bag and purged for 30 minutes at an overpressure of 0.2 psi. The containers of coating composition and coupons were inserted into the glove bag and the coating composition was poured (~4 ml) into the 5-neck electroplating flask (a Gamry "Dr. Bob" cell). The coating composition was heated to the desired temperature (20-125° C.), as was set to stir at 1200 RPM until heated at which time the stir was reduced to 60 RPM. The argon cover gas and bubbler were turned on and used to purify any contaminates (e.g., water) that remained in the coating composition. The cover gases were left on at all times during plating and were used to remove plating off-gasses and keep all oxygen away from the coating composition. The gases were used at all times and were the last things to be turned off in the setup. The Mo substrate was sonicated in alcohol for 60 seconds and then allowed to dry in the ambient Ar environment of the bag. The metal coupon was inserted into the custom clip electrode (or Gamry electrode holder) and placed in the center neck of the plating cell. This electrode is termed the "working electrode". The other 4 necks comprised: the bubbler and cover gas manifold, the reference electrode, the counter electrode, and the gas outlet. In some examples, the counter electrode is glassy carbon; however, Pt alloys and/or graphite electrodes can be used. The plating program is turned on and the plating commences (either DC or pulsed plating) for the desired time (e.g., 0-6 hours). The program then turns the voltage to −1.84. The program runs to completion and the hardware automatically shuts off. The coupon(s) was then removed from the coating composition and allowed to cool. It is then rinsed in isopropyl alcohol and sonicated (20 kHz) in same for 5 minutes. The coupon is dried in argon and sealed in a fresh glass container under argon for analysis. The above procedure was repeated using Zr and Cu substrates.

Example 9

In this example, a molybdenum (Mo) substrate was coated with the coating composition of Example 4. Coupons of Mo were cut to 0.5×4 cm widths from metal foils sheets. The coupons were then abrasively cleaned with a brillo pad for 30 seconds and cleaned under a nitrogen jet to remove fines. The coupons were then sealed in glass vials under argon and numbered with the same number as their intended coating composition.

Coating compositions in sealed containers with rubber septa lids were inserted into the exchange chamber of the glove bag along with the containers containing the metal coupon(s) as well as any other tools used for the plating. The argon flow was turned on to the glove bag and purged for 30 minutes at an overpressure of 0.2 psi. The containers of coating composition and coupons were inserted into the glove bag and the coating composition was poured (~4 ml) into the 5-neck electroplating flask (a Gamry "Dr. Bob" cell). The coating composition was heated to the desired temperature (20-125° C.), as was set to stir at 1200 RPM until heated at which time the stir was reduced to 60 RPM. The argon cover gas and bubbler were turned on and used to purify any contaminates (e.g., water) that remained in the coating composition. The cover gases were left on at all times during plating and were used to remove plating off-gasses and keep all oxygen away from the coating composition. The gases were used at all times and were the last things to be turned off in the setup. The Mo substrate was sonicated in alcohol for 60 seconds and then allowed to dry in the ambient Ar environment of the bag. The metal coupon was inserted into the custom clip electrode (or Gamry electrode holder) and placed in the center neck of the plating cell. This electrode is termed the "working electrode". The other 4 necks comprised: the bubbler and cover gas manifold, the reference electrode, the counter electrode, and the gas outlet. In some examples, the counter electrode is glassy carbon; however, Pt alloys and/or graphite electrodes can be used. The plating program is turned on and the plating commences (either DC or pulsed plating) for the desired time (e.g., 0-6 hours). The program then turns the voltage to −1.84. The program runs to completion and the hardware automatically shuts off. The coupon(s) was then removed from the coating composition and allowed to cool. It is then rinsed in isopropyl alcohol and sonicated (20 kHz) in same for 5 minutes. The coupon is dried in argon and sealed in a fresh glass container under argon for analysis. The above procedure was repeated using Zr and Cu substrates.

Example 10

In this example, a molybdenum (Mo) substrate was coated with the coating composition of Example 5. Coupons of Mo were cut to 0.5×4 cm widths from metal foils sheets. The coupons were then abrasively cleaned with a brillo pad for 30 seconds and cleaned under a nitrogen jet to remove fines. The coupons were then sealed in glass vials under argon and numbered with the same number as their intended coating composition.

Coating compositions in sealed containers with rubber septa lids were inserted into the exchange chamber of the glove bag along with the containers containing the metal coupon(s) as well as any other tools used for the plating. The argon flow was turned on to the glove bag and purged for 30 minutes at an overpressure of 0.2 psi. The containers of coating composition and coupons were inserted into the glove bag and the coating composition was poured (~4 ml) into the 5-neck electroplating flask (a Gamry "Dr. Bob" cell). The coating composition was heated to the desired temperature (20-125° C.), as was set to stir at 1200 RPM until heated at which time the stir was reduced to 60 RPM. The argon cover gas and bubbler were turned on and used to purify any contaminates (e.g., water) that remained in the coating composition. The cover gases were left on at all times during plating and were used to remove plating off-gasses and keep all oxygen away from the coating composition. The gases were used at all times and were the last things to be turned off in the setup. The Mo substrate was sonicated in alcohol for 60 seconds and then allowed to dry in the ambient Ar environment of the bag. The metal coupon was inserted into the custom clip electrode (or Gamry electrode holder) and placed in the center neck of the plating cell. This electrode is termed the "working electrode". The other 4 necks comprised: the bubbler and cover gas manifold, the reference electrode, the counter electrode, and the gas outlet. In some examples, the counter electrode is glassy carbon; however, Pt alloys and/or graphite electrodes can be used. The plating program is turned on and the plating commences (either DC or pulsed plating) for the desired time (e.g., 0-6 hours). The program then turns the voltage to −1.84. The program runs to completion and the hardware automatically shuts off. The coupon(s) was then removed from the coating composition and allowed to cool. It is then rinsed in isopropyl alcohol and sonicated (20 kHz) in same for 5 minutes. The coupon is dried in argon and sealed in a fresh glass container under argon for analysis.

The above procedure was repeated using Zr and Cu substrates.

Figure 13:
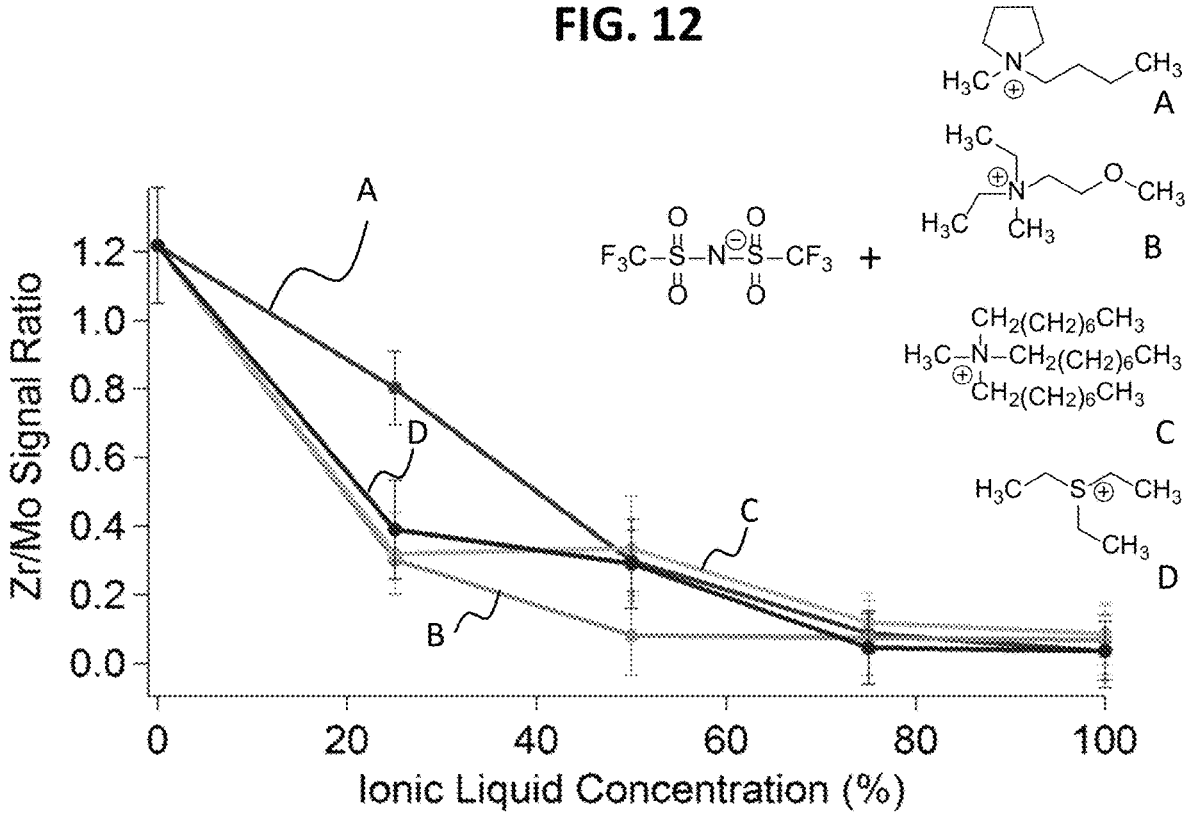
FIG. 13 is a graph of Zr/Mo signal ratio as a function of ionic liquid concentration (%) showing results obtained from using different ionic liquids in a coating composition.
Figure 14:
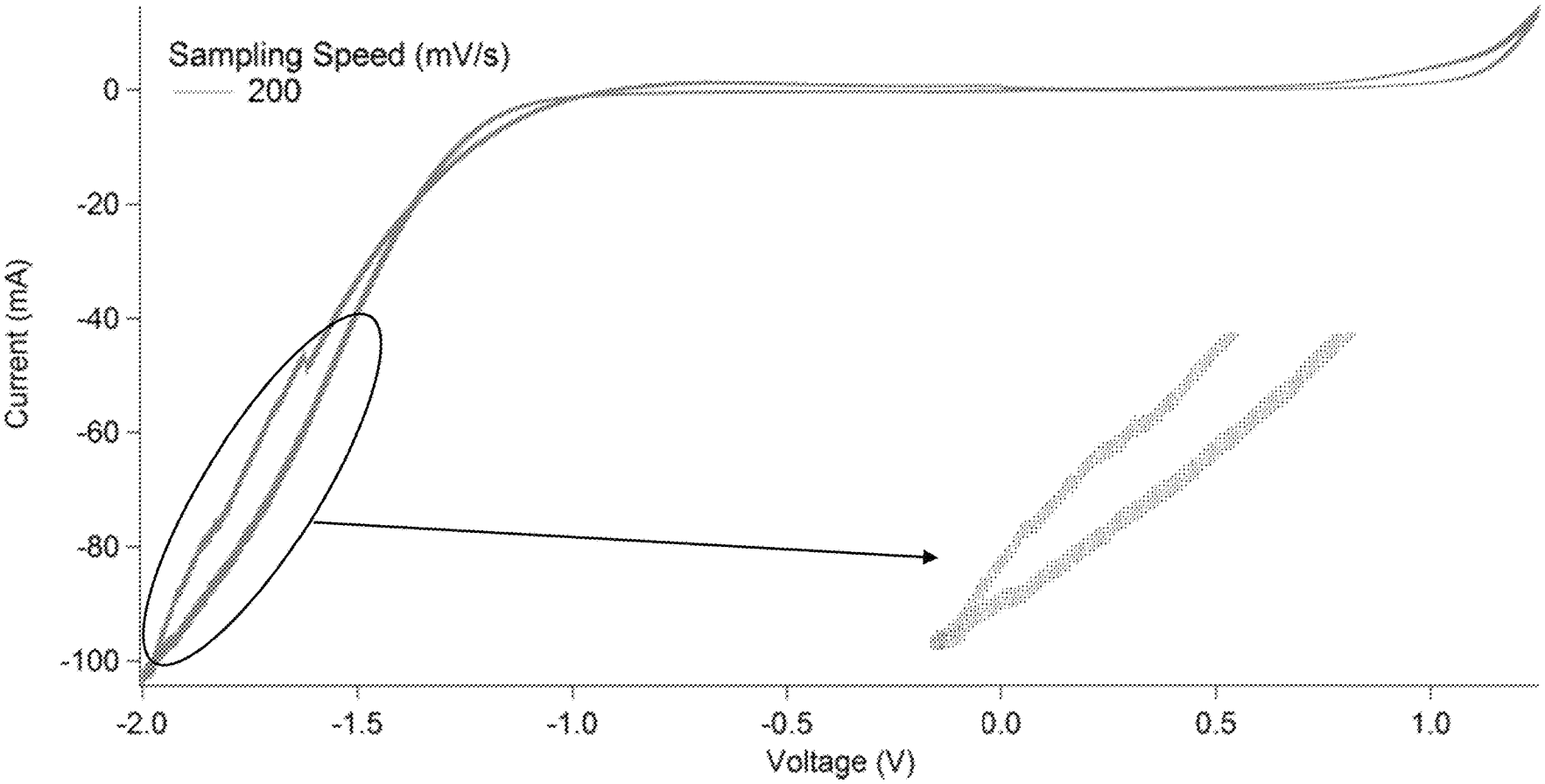
FIG. 14 is a graph of current (mA) as a function of voltage (V) showing a cyclic voltammogram generated during a representative method embodiment of the present disclosure, which illustrates representative voltage ranges for different deposition events occurring during the method embodiment; two voltage ranges are highlighted, with one occurring between voltages of −1.81 V to −1.85 V, corresponding Zr deposition; and a second occurring between −0.6 V to −0.5 V, corresponding to $ZrCl_2$ deposition.
Figure 15:
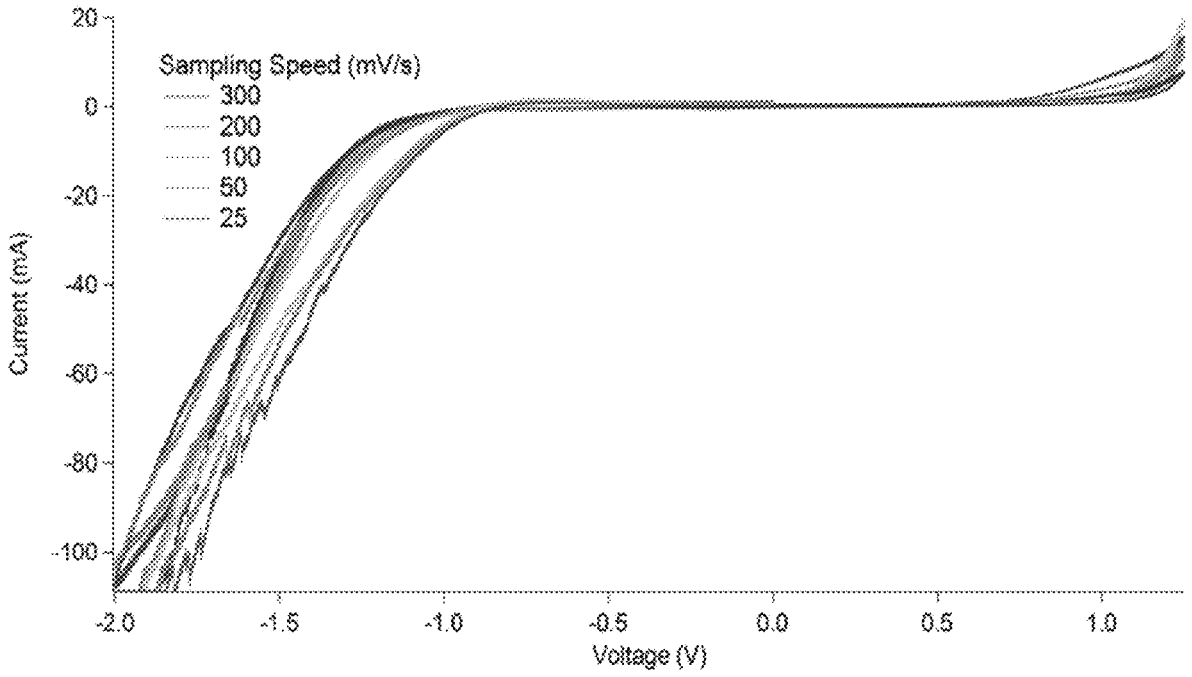
FIG. 15 is a graph of current (mA) as a function of voltage (V) showing cyclic voltammograms obtained using different sampling speeds (mV/s).

Results comparing the Zr to Mo signal ratio observed for coatings made from coating composition examples 1-5 are summarized in the XRF graph shown by FIG. 13. FIG. 14 shows a cyclic voltammogram and corresponding deposition events over a range of voltages used in an exemplary embodiment of a coating composition embodiment comprising a DES without an ionic liquid and FIG. 15 shows results obtained from using different sampling speeds.

Example 11

In this example, molybdenum (Mo) substrates are coated with coating composition embodiments similar to Examples 1-5, but using $TiF_4$ as the metal precursor component instead of $ZrF_4$. Briefly, ethaline and an ionic liquid (according to each different ionic liquid used in Examples 1-5) are drawn with a pipette and injected into a new glass vial. A glass stir bar is added and the vial is sealed with a rubber needle septum. Two hypodermic needles are injected into the headspace above the liquid. One needle carries argon gas flow and the other vacuum. The argon flow injects Ar by gas jet into the liquid. The pressure is maintained below 1 atm (~0.95 atm) to not build pressure in the system. The liquid is heated in this way to 150° C. for 24 to 72 hours to remove water and oxygen from within the system under high stir. $TiF_4$ and LiF salts are ground with a pistol and mortar until fine prior to addition. Both salts are added to a clean glass vial with a glass stir bar. The vial is sealed with a rubber septum and evacuated. The mixture of DES and ionic liquid is added to the salts by needle injection. The mix is vortexed on high for 1 minute and sonicated under a 20 kHz bath sonicator for 1 hour. The solution is then evacuated for 1 hour under stirring to remove any water or air that may inadvertently enter the coating composition's vial. In particular embodiments, $TiF_4$ is added to bring the final concentration to 0.25 M and LiF is added in a similar way to a concentration of 0.5 M.

Coupons of Mo are abrasively cleaned with a brillo pad for 30 seconds and cleaned under a nitrogen jet to remove fines and are then sealed in glass vials under argon and numbered with the same number as their intended coating composition.

In separate examples, samples of each coating composition embodiment (in sealed containers with rubber septa lids) are inserted into the exchange chamber of the glove bag along with the containers containing the metal coupon(s) as well as any other tools used for the plating. The argon flow is turned on to the glove bag and purged for 30 minutes at an overpressure of 0.2 psi. The containers of coating compositions and coupons are inserted into the glove bag and the coating composition comprising the $TiF_4$ is poured (~4 ml) into the 5-neck electroplating flask (a Gamry "Dr. Bob" cell). The coating composition is heated to the desired temperature (20-125° C.), as is set to stir at 1200 RPM until heated at which time the stir is can be reduced to 60 RPM. The argon cover gas and bubbler are turned on and used to purify any contaminates (water) that remain in the coating composition. The cover gases are left on at all times during plating and are used to remove plating off-gasses and keep all oxygen away from the coating composition. The gases are used at all times and are the last things to be turned off in the setup. The Mo substrate is sonicated in alcohol for 60 seconds and then allowed to dry in the ambient Ar environment of the bag. The metal coupon is inserted into the custom clip electrode (or Gamry electrode holder) and placed in the center neck of the plating cell. This electrode is termed the "working electrode". The other 4 necks comprise: the bubbler and cover gas manifold, the reference electrode, the counter electrode, and the gas outlet. In some examples, the counter electrode is glassy carbon; however, Pt alloys and/or graphite electrodes can be used. The plating program is turned on and the plating commences (either DC or pulsed plating) for the desired time (e.g., 0-6 hours). The program then turns the voltage to a voltage capable of depositing Ti, with such voltages being discussed herein. The program runs to completion and the hardware automatically shuts off. Each coupon is then removed from the coating composition and allowed to cool. It is then rinsed in isopropyl alcohol and sonicated (20 kHz) in same for 5 minutes. The coupon is dried in argon and sealed in a fresh glass container under argon for analysis.

In view of the many possible embodiments to which the principles of the present disclosure may be applied, it should be recognized that the illustrated embodiments are only preferred examples and should not be taken as limiting the scope of the present disclosure. Rather, the scope is defined by the following claims. We therefore claim as our invention all that comes within the scope and spirit of these claims.

We claim:

1. A method, comprising:

combining, in a cell, (a) a coating composition comprising (i) a deep eutectic solvent comprising an organic salt, a hydrogen-bond donor compound, or a combination thereof; (ii) an ionic liquid; (iii) a metal precursor that is a refractory metal salt compound comprising a refractory metal selected from Zr, Ti, V, Cr, Mn, Nb, Mo, Tc, Ru, Rh, Hf, Ta, W, Re, Os, or Ir; and a halide selected from a fluoride or a bromide; and (iv) an alkali metal salt comprising an alkali metal and a halide counterion; and (b) a substrate such that at least a portion of the substrate is immersed in the coating composition, wherein the cell further comprises a reference electrode and/or a counter electrode; and exposing the cell to a voltage to thereby deposit a metal coating on the substrate from the coating composition.

2. The method of claim 1, wherein the substrate is a Mo substrate, a Cu substrate, a Zr substrate, a steel substrate, a U substrate, an Al substrate, or a substrate comprising any combination of Mo, Cu, Zr, U, steel, or Al.

3. The method of claim 1, wherein the voltage consists of a DC voltage or a pulsed DC voltage.

4. The method of claim 1, wherein the voltage is applied as a pulsed DC voltage such that voltage is applied at a timed interval comprising a 100 ms time period where voltage is applied and a 10 ms time period where no voltage is applied and wherein the timed interval is repeated at least two times.

5. The method of claim 4, wherein the cell is maintained at a temperature ranging from ambient temperature to 150° C.

6. The method of claim 4, wherein the coating composition comprises $ZrF_4$ as the metal precursor.

7. The method of claim 4, wherein the coating composition comprises $TiF_4$ as the metal precursor.

8. The method of claim 1, wherein the deep eutectic solvent comprises a mixture of the organic salt and the hydrogen-bond donor compound.

9. The method of claim 1, wherein the organic salt is present and comprises a quaternary ammonium compound and a counterion selected from a halide, an acetate, or a bitartrate.

10. The method of claim 9, wherein the quaternary ammonium compound is selected from choline, N-ethyl-2-hydroxy-N,N-dimethylethanaminium, 2-(chlorocarbonyloxy)-N,N,N-trimethylethanaminium, or N-benzyl-2-hydroxy-N,N-dimethylethanaminium.

11. The method of claim 9, wherein the counterion is a halide selected from a chloride or a bromide.

12. The method of claim 1, wherein the hydrogen-bond donor compound is present and is selected from urea, acetamide, 1-methyl urea, 1,3-dimethyl urea, 1,1-dimethyl urea, thiourea, benzamide, glycerol, ethylene glycol, malonic acid, benzoic acid, adipic acid, oxalic acid, succinic acid, citric acid, acetic acid, or combinations thereof.

13. The method of claim 1, wherein the deep eutectic solvent comprises choline chloride, choline bromide, choline acetate, choline bitartrate, or a combination thereof; and urea, acetamide, 1-methyl urea, 1,3-dimethyl urea, 1,1-dimethyl urea, thiourea, benzamide, glycerol, ethylene glycol, malonic acid, benzoic acid, adipic acid, oxalic acid, succinic acid, citric acid, acetic acid, or combinations thereof.

14. The method of claim 1, wherein the deep eutectic solvent comprises choline chloride and ethylene glycol.

15. The method of claim 14, wherein the choline chloride and ethylene glycol are present in a ratio ranging from 1:3 choline chloride:ethylene glycol to 3:1 choline chloride: ethylene glycol.

16. The method of claim 1, wherein the ionic liquid comprises a cationic component and an anionic component, wherein the cationic component is a positively-charged compound comprising a quaternary substituted nitrogen atom or a tri-substituted sulfur atom and the anionic component is a bis-substituted imide compound.

17. The method of claim 1, wherein the ionic liquid is selected from triethylsulfonium bis(trifluoromethylsulfonyl)imide, 1-butyl-3-methylpyridinium bis(trifluormethylsulfonyl)imide, methyl-trioctylammonium bis(trifluoromethylsulfonyl)imide, diethylmethyl(2-methoxyethyl)ammonium bis(trifluoromethylsulfonyl)imide, or a combination thereof.

18. The method of claim 1, wherein the metal precursor is selected from $ZrF_4$, $TiF_4$, $WF_4$, $NbF_4$, $NbF_5$, $TaF_3$, $TaF_5$, $HfF_4$, $VF_3$, $VF_4$, $IrF_4$, $IrF_5$, $ZrBr_4$, $TiBr_4$, $WBr_4$, $NbBr_4$, $NbBr_5$, $TaBr_3$, $TaBr_5$, $HfBr_4$, $VBr_3$, $VBr_4$, $IrBr_4$, or $IrBr_5$.

19. The method of claim 1, wherein the deep eutectic solvent comprises the organic salt and the hydrogen-bond donor compound and wherein the metal precursor is $ZrF_4$.

20. The method of claim 1, wherein the deep eutectic solvent comprises the organic salt and the hydrogen-bond donor compound and wherein the metal precursor is $TiF_4$.

21. The method of claim 1, wherein the alkali metal salt is LiF.

22. The method of claim 1, wherein the coating composition further comprises an additive component selected from urea, a pH-controlling reagent, or a reducing agent.

23. A method, comprising:

combining, in a cell, (a) a substantially water-free coating composition comprising (i) a deep eutectic solvent comprising an organic salt and a hydrogen-bond donor compound; (ii) an ionic liquid; (iii) a metal precursor that is a refractory metal salt compound comprising a refractory metal selected from Zr, Ti, V, Cr, Mn, Nb, Mo, Tc, Ru, Rh, Hf, Ta, W, Re, Os, or Ir; and a halide selected from a fluoride or a bromide; and (iv) an alkali metal salt comprising an alkali metal and a halide counterion; and (b) a substrate such that at least a portion of the substrate is immersed in the coating composition, wherein the cell further comprises a reference electrode and/or a counter electrode; and exposing the cell to a voltage to thereby deposit a metal coating on the substrate from the coating composition.

* * * * *